US010221669B2

(12) United States Patent
Tolman et al.

(10) Patent No.: US 10,221,669 B2
(45) Date of Patent: Mar. 5, 2019

(54) WELLBORE TUBULARS INCLUDING A PLURALITY OF SELECTIVE STIMULATION PORTS AND METHODS OF UTILIZING THE SAME

(71) Applicants: Randy C. Tolman, Spring, TX (US); P. Matthew Spiecker, Manvel, TX (US); Steve Lonnes, Spring, TX (US); Timothy J. Hall, Houston, TX (US)

(72) Inventors: Randy C. Tolman, Spring, TX (US); P. Matthew Spiecker, Manvel, TX (US); Steve Lonnes, Spring, TX (US); Timothy J. Hall, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 241 days.

(21) Appl. No.: 15/264,064

(22) Filed: Sep. 13, 2016

(65) Prior Publication Data

US 2017/0159418 A1 Jun. 8, 2017

Related U.S. Application Data

(60) Provisional application No. 62/262,036, filed on Dec. 2, 2015.

(51) Int. Cl.
*E21B 43/263* (2006.01)
*E21B 41/00* (2006.01)
(Continued)

(52) U.S. Cl.
CPC ..... *E21B 43/263* (2013.01); *E21B 23/04* (2013.01); *E21B 29/08* (2013.01); *E21B 34/063* (2013.01);
(Continued)

(58) Field of Classification Search
CPC ..... E21B 43/263; E21B 23/04; E21B 29/08; E21B 34/063; E21B 34/14;
(Continued)

(56) References Cited

U.S. PATENT DOCUMENTS 3,167,122 A 1/1965 Lang
3,450,203 A 6/1969 Patron et al.
(Continued)

FOREIGN PATENT DOCUMENTS

AU 2015 201029 3/2015
WO WO 2003/002849 1/2003
(Continued)

OTHER PUBLICATIONS

Halliburton, "*Illusion Frac Plug*,"downloaded from http://www.halliburton.com/en-US/news/announcements/halliburton-introduces-illusion-frac-plug.page?node-id=hgeystfs, Jun. 15, 2015, p. 1.

*Primary Examiner* — Yong-Suk Ro
(74) *Attorney, Agent, or Firm* — ExxonMobil Upstream Research Company—Law Department

(57) ABSTRACT

Wellbore tubulars including a plurality of selective stimulation ports and methods of utilizing the same. The wellbore tubulars include a tubular body including an external surface and an internal surface that defines a tubular conduit. The wellbore tubulars also include a plurality of selective stimulation ports, and each selective stimulation port includes a SSP conduit and an isolation device that is configured to selectively transition from a closed state to an open state responsive to a shockwave having greater than a threshold shockwave intensity. The methods include methods of stimulating a subterranean formation utilizing the wellbore tubulars. The methods also include methods of re-stimulating the subterranean formation utilizing the wellbore tubulars.

29 Claims, 11 Drawing Sheets

(51) Int. Cl.

| | |
|---|---|
| ***E21B 34/06*** | (2006.01) |
| ***E21B 34/14*** | (2006.01) |
| ***E21B 43/267*** | (2006.01) |
| ***E21B 23/04*** | (2006.01) |
| ***E21B 29/08*** | (2006.01) |
| ***E21B 43/114*** | (2006.01) |
| ***E21B 43/14*** | (2006.01) |
| ***E21B 43/25*** | (2006.01) |
| *E21B 34/00* | (2006.01) |
| *E21B 43/26* | (2006.01) |

(52) U.S. Cl.
CPC ..... *E21B 34/14* (2013.01); *E21B 41/0078* (2013.01); *E21B 43/114* (2013.01); *E21B 43/14* (2013.01); *E21B 43/25* (2013.01); *E21B 43/267* (2013.01); *E21B 43/26* (2013.01); *E21B 2034/007* (2013.01)

(58) Field of Classification Search
CPC .... E21B 41/0078; E21B 43/114; E21B 43/14; E21B 43/25; E21B 43/267; E21B 43/26; E21B 2034/007
See application file for complete search history.

(56) References Cited

U.S. PATENT DOCUMENTS

| | | | | |
|---|---|---|---|---|
| 5,234,055 | A | 8/1993 | Cornette | |
| 5,579,844 | A | 12/1996 | Rebardi et al. | |
| 5,704,426 | A | 1/1998 | Rytlewski et al. | |
| 5,829,520 | A | 11/1998 | Johnson | |
| 6,095,247 | A | 8/2000 | Streich et al. | |
| 6,155,494 | A | 12/2000 | Fabbri et al. | |
| 6,394,184 | B2 | 5/2002 | Tolman et al. | |
| 6,543,538 | B2 | 4/2003 | Tolman et al. | |
| 6,907,936 | B2 | 6/2005 | Fehr et al. | |
| 6,957,701 | B2 | 10/2005 | Tolman et al. | |
| 7,059,407 | B2 | 6/2006 | Tolman et al. | |
| 7,168,494 | B2 | 1/2007 | Starr et al. | |
| 7,353,879 | B2 | 4/2008 | Todd et al. | |
| 7,357,151 | B2 | 4/2008 | Lonnes | |
| 7,467,778 | B2 | 12/2008 | Lonnes | |
| 7,477,160 | B2 | 1/2009 | Lemenager et al. | |
| 7,516,792 | B2 | 4/2009 | Lonnes et al. | |
| 7,575,062 | B2 | 8/2009 | East, Jr. | |
| 7,735,559 | B2 | 6/2010 | Malone | |
| 7,798,236 | B2 | 9/2010 | McKeachnie et al. | |
| 8,167,047 | B2 | 5/2012 | Themig et al. | |
| 8,215,411 | B2 | 7/2012 | Flores et al. | |
| 8,220,542 | B2 | 7/2012 | Whitsitt et al. | |
| 8,237,585 | B2 | 8/2012 | Zimmerman | |
| 8,267,177 | B1 | 9/2012 | Vogel et al. | |
| 8,276,670 | B2 | 10/2012 | Patel | |
| 8,330,617 | B2 | 12/2012 | Chen et al. | |
| 8,347,982 | B2 | 1/2013 | Hannegan et al. | |
| 8,496,055 | B2 | 7/2013 | Mootoo et al. | |
| 8,695,506 | B2 | 4/2014 | Lanclos | |
| 9,995,123 | B2 * | 6/2018 | Antonsen | E21B 23/006 |
| 2002/0007949 | A1 | 1/2002 | Tolman et al. | |
| 2004/0084190 | A1 | 5/2004 | Hill et al. | |
| 2006/0118301 | A1 | 6/2006 | East, Jr. et al. | |
| 2008/0093073 | A1 | 4/2008 | Bustos et al. | |
| 2008/0156498 | A1 | 7/2008 | Phi et al. | |
| 2008/0296024 | A1 | 12/2008 | Huang et al. | |
| 2009/0032255 | A1 | 2/2009 | Surjaatmadja et al. | |
| 2009/0101334 | A1 | 4/2009 | Baser et al. | |
| 2010/0044041 | A1 * | 2/2010 | Smith | E21B 34/14 166/280.1 |
| 2010/0084134 | A1 | 4/2010 | Tulissi et al. | |
| 2010/0122817 | A1 | 5/2010 | Surjaatmadja et al. | |
| 2011/0048743 | A1 | 3/2011 | Stafford et al. | |
| 2011/0168403 | A1 | 7/2011 | Patel | |
| 2011/0278017 | A1 * | 11/2011 | Themig | E21B 34/14 166/373 |
| 2012/0037366 | A1 | 2/2012 | Sherman | |
| 2012/0043079 | A1 | 2/2012 | Wassouf et al. | |
| 2012/0085548 | A1 | 4/2012 | Fleckenstein et al. | |
| 2012/0090687 | A1 | 4/2012 | Grigsby et al. | |
| 2012/0111566 | A1 | 5/2012 | Sherman et al. | |
| 2012/0199349 | A1 | 8/2012 | Themig et al. | |
| 2012/0292053 | A1 | 11/2012 | Xu et al. | |
| 2013/0008648 | A1 | 1/2013 | Lovorn et al. | |
| 2013/0062055 | A1 | 3/2013 | Tolman et al. | |
| 2013/0062072 | A1 | 3/2013 | Alvarez et al. | |
| 2013/0105159 | A1 | 5/2013 | Alvarez et al. | |
| 2013/0199790 | A1 | 8/2013 | Themig et al. | |
| 2013/0206425 | A1 | 8/2013 | Mazyar et al. | |
| 2013/0248174 | A1 | 9/2013 | Dale et al. | |
| 2013/0255939 | A1 | 10/2013 | Kumaran et al. | |
| 2014/0131035 | A1 | 5/2014 | Entchev et al. | |
| 2014/0305877 | A1 | 10/2014 | Cioanta et al. | |
| 2015/0176388 | A1 | 6/2015 | Tolman et al. | |
| 2015/0315872 | A1 | 11/2015 | Phi et al. | |
| 2015/0330185 | A1 * | 11/2015 | Hughes | E21B 33/1216 166/318 |

FOREIGN PATENT DOCUMENTS

| | | |
|---|---|---|
| WO | WO 2007/115051 | 10/2007 |
| WO | WO 2007/134598 | 11/2007 |
| WO | WO 2014/077949 | 5/2014 |
| WO | WO 2014/184587 | 11/2014 |
| WO | WO 2015/073030 | 5/2015 |

* cited by examiner

WELLBORE TUBULARS INCLUDING A PLURALITY OF SELECTIVE STIMULATION PORTS AND METHODS OF UTILIZING THE SAME

CROSS REFERENCE TO RELATED APPLICATIONS

This application claims the benefit of U.S. Provisional Application No. 62/262,036 filed Dec. 2, 2015, entitled, "Wellbore Tubulars Including A Plurality of Selective Stimulation Ports and Methods of Utilizing the Same," the entirety of which is incorporated by reference herein.

This application is related to U.S. Provisional Application Ser. No. 62/262,034 filed Dec. 2, 2015, entitled, "Selective Stimulation Ports, Wellbore Tubulars That Include Selective Stimulation Ports, and Methods of Operating the Same,"; U.S. Provisional Application Ser. No. 62/263,065 filed Dec. 4, 2015, entitled, "Wellbore Ball Sealer and Methods of Utilizing the Same,"; U.S. Provisional Application Ser. No. 62/263,067 filed Dec. 4, 2015, entitled, "Ball-Sealer Check-Valves for Wellbore Tubulars and Methods of Utilizing the Same,"; U.S. Provisional Application Ser. No. 62/263,069 filed Dec. 4, 2015, entitled, "Select-Fire, Downhole Shock-wave Generation Devices, Hydrocarbon Wells That Include the Shockwave Generation Devices, and Methods of Utilizing the Same,"; and U.S. Provisional Application Ser. No. 62/329,690 filed Apr. 29, 2016, entitled, "System and Method for Autonomous Tools,", the disclosures of which are incorporated herein by reference in their entireties.

FIELD OF THE DISCLOSURE

The present disclosure is directed generally to wellbore tubulars including a plurality of selective stimulation ports and to methods of utilizing the wellbore tubulars.

BACKGROUND OF THE DISCLOSURE

Hydrocarbon wells generally include a wellbore that extends from a surface region and/or that extends within a subterranean formation that includes a reservoir fluid, such as liquid and/or gaseous hydrocarbons. Often, it may be desirable to stimulate the subterranean formation to enhance production of the reservoir fluid therefrom. Stimulation of the subterranean formation may be accomplished in a variety of ways and generally includes supplying a stimulant fluid to the subterranean formation to increase reservoir contact. As an example, the stimulation may include supplying an acid to the subterranean formation to acid-treat the subterranean formation and/or to dissolve at least a portion of the subterranean formation. As another example, the stimulation may include fracturing the subterranean formation, such as by supplying a fracturing fluid, which is pumped at a high pressure, to the subterranean formation. The fracturing fluid may include particulate material, such as a proppant, which may at least partially fill fractures that are generated during the fracturing, thereby facilitating fluid flow within the fractures after supply of the fracturing fluid has ceased.

A variety of systems and/or methods have been developed to facilitate stimulation of subterranean formations, and each of these systems and methods generally has inherent to benefits and drawbacks. These systems and methods often utilize a shape charge perforation gun to create perforations within a casing string that extends within the wellbore, and the stimulant fluid then is provided to the subterranean formation via the perforations. However, such systems suffer from a number of limitations. As an example, the perforations may not be round or may have burrs, which may make it challenging to seal the perforations subsequent to stimulating a given region of the subterranean formation. As another example, the perforations often will erode and/or corrode due to flow of the stimulant fluid, flow of proppant, and/or long-term flow of reservoir fluid therethrough. This may make it challenging to seal the perforations and/or may change fluid flow characteristics therethrough. These challenges may occur early in the life of the hydrocarbon well, such as during and/or after completion thereof, and/or later in the life of the hydrocarbon well, such as after production of the reservoir fluid with the hydrocarbon well and/or during and/or after restimulation of the hydrocarbon well. As yet another example, it may be challenging to precisely locate, size, and/or orient perforations, which are created utilizing the shape charge perforation gun, within the casing string. Thus, there exists a need for improved systems and methods for stimulating a subterranean formation, such as may be facilitated utilizing the wellbore tubulars disclosed herein.

SUMMARY OF THE DISCLOSURE

Wellbore tubulars including a plurality of selective stimulation ports and methods of utilizing the same are disclosed herein. The wellbore tubulars include a tubular body including an external surface and an internal surface that defines a tubular conduit. The wellbore tubulars also include a plurality of selective stimulation ports (SSPs), and each SSP includes an SSP conduit that extends between the internal surface of the tubular body and the external surface of the tubular body. Each SSP also includes an isolation device that is configured to selectively transition from a closed state to an open state responsive to receipt of a shockwave having greater than a threshold shockwave intensity. In the closed state, the isolation device restricts fluid flow through the SSP conduit, while, in the open state, the isolation device permits fluid flow through the SSP conduit.

The methods include methods of stimulating a subterranean formation utilizing the wellbore tubulars. These methods include generating a shockwave with a shockwave generation device and within a wellbore fluid that extends within a tubular conduit. These methods further include transitioning a selected isolation device of each of a selected fraction of the plurality of SSPs from a respective closed state to a respective open state. The transitioning is responsive to receipt of the shockwave with greater than the threshold shockwave intensity by the selected isolation device.

The methods also include methods of re-stimulating the subterranean formation utilizing the wellbore tubulars. These methods include extending the wellbore tubular within a casing conduit that is defined by a casing string and pressurizing a tubular conduit of the wellbore tubular with a stimulant fluid that includes an abrasive material. These methods further include generating a shockwave within the tubular conduit and proximal a selected fraction of the plurality of SSPs and transitioning each isolation device of the selected fraction of the plurality of SSPs from a respective closed state to a respective open state responsive to receipt of the shockwave. These methods also include flowing the stimulant fluid through a selected SSP conduit of each of the selected fraction of the plurality of SSPs such that the stimulant fluid impinges upon an inner surface of the casing string and abrading the casing string with the abrasive material to form a hole in the casing string. These methods further include flowing the stimulant fluid into the subterranean formation, via the hole, to stimulate the subterranean formation.

DETAILED DESCRIPTION AND BEST MODE OF THE DISCLOSURE

Figure 1:
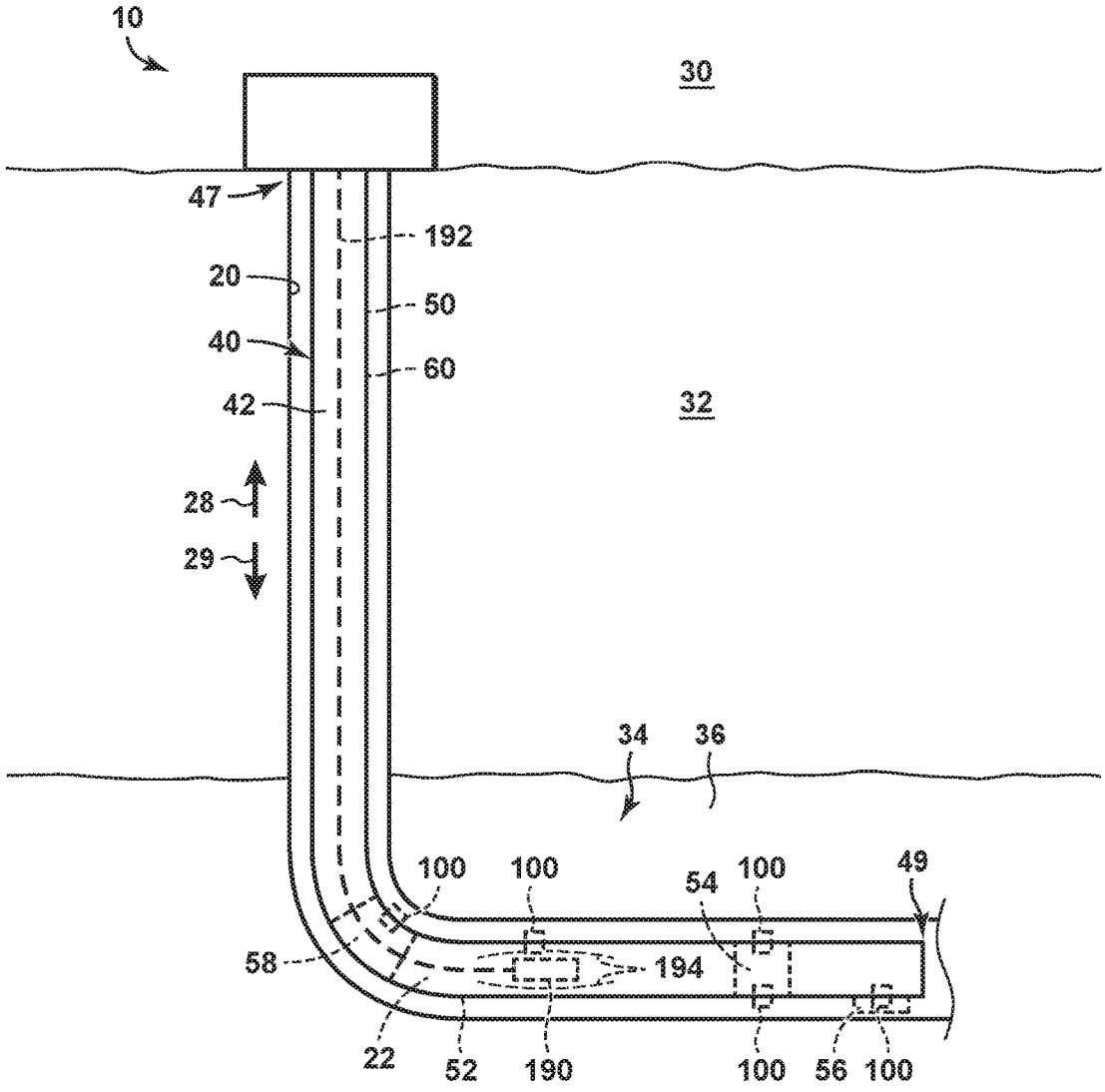
FIG. 1 is a schematic representation of examples of a hydrocarbon well that may include and/or utilize wellbore tubulars and/or methods according to the present disclosure.

FIGS. 1-19 provide examples of wellbore tubulars 40, of methods 400 of stimulating a subterranean formation, of methods 600/700 of re-stimulating a subterranean formation, and/or of process flows 310/320/330, according to the present disclosure. Elements that serve a similar, or at least substantially similar, purpose are labeled with like numbers in each of FIGS. 1-19, and these elements may not be discussed in detail herein with reference to each of FIGS. 1-19. Similarly, all elements may not be labeled in each of FIGS. 1-19, but reference numerals associated therewith may be utilized herein for consistency. Elements, components, and/or features that are discussed herein with reference to one or more of FIGS. 1-19 may be included in and/or utilized with any of FIGS. 1-19 without departing from the scope of the present disclosure. In general, elements that are likely to be included in a particular embodiment are illustrated in solid lines, while elements that are optional are illustrated in dashed lines. However, elements that are shown in solid lines may not be essential and in some embodiments may be omitted without departing from the scope of the present disclosure.

FIG. 1 is a schematic representation of examples of a hydrocarbon well 10 that may include and/or utilize wellbore tubulars 40, process flows 310/320/330, and/or methods 400/600/700 according to the present disclosure. Hydrocarbon well 10 includes a wellbore 20 that extends from a surface region 30, within a subsurface region 32, within a subterranean formation 34 of subsurface region 32, and/or between the surface region and the subterranean formation. Subterranean formation 34 includes a reservoir fluid 36, such as a liquid hydrocarbon and/or a gaseous hydrocarbon, and hydrocarbon well 10 may be utilized to produce, pump, and/or convey the reservoir fluid from the subterranean formation and/or to the surface region.

Hydrocarbon well 10 further includes wellbore tubular 40, which extends within wellbore 20 and defines a tubular conduit 42. Wellbore tubular 40 includes a plurality of selective stimulation ports (SSPs) 100, which are discussed in more detail herein. SSPs 100 are illustrated in dashed lines in FIG. 1 to indicate that the SSPs may be operatively attached to and/or may form a portion of any suitable component of wellbore tubular 40. Wellbore tubular 40 includes an uphole tubular end 47 and a downhole tubular end 49, and the uphole tubular end may be located relatively uphole from, and/or may be located in an uphole direction 28 from, the downhole tubular end. Conversely, the downhole tubular end may be located relatively downhole from, and/or may be located in a downhole direction 29 from, the uphole tubular end.

Wellbore tubular 40 may include and/or be any suitable tubular that may be present, located, and/or extended within wellbore 20. As an example, wellbore tubular 40 may include and/or be a casing string 50. As another example, wellbore tubular 40 may include and/or be an inter-casing tubing 60, which may be configured to extend within a casing string. SSPs 100 may be configured to be operatively attached to wellbore tubular 40, such as to casing string 50 and/or inter-casing tubing 60, prior to the wellbore tubular being located, placed, and/or installed within wellbore 20.

When wellbore tubular 40 includes casing string 50, SSPs 100 may be operatively attached to any suitable portion of the casing string. As examples, and as illustrated, one or more SSPs 100 may be operatively attached to one or more of a casing segment 52 of the casing string, such as a sub or pup joint of the casing string, a casing collar 54 of the casing string, a blade centralizer 56 of the casing string, and/or a sleeve 58 that extends around the outer surface of the casing string.

SSPs 100 may be operatively attached to wellbore tubular 40 in any suitable manner. As examples, SSPs 100 may be operatively attached to wellbore tubular 40 via one or more of a threaded connection, a glued connection, a press-fit connection, a welded connection, and/or a brazed connection.

As illustrated in dashed lines in FIG. 1, hydrocarbon well 10 also may include and/or have associated therewith an optional shockwave generation device 190. Shockwave generation device 190 may be configured to generate a shockwave 194 within tubular conduit 42, as discussed in more detail herein. Shockwave generation device 190 may include and/or be any suitable structure that may, or may be utilized to, generate the shockwave within tubular conduit 42. As an example, shockwave generation device 190 may be an umbilical-attached shockwave generation device 190 that may be operatively attached to, or may be positioned within tubular conduit 42 via, an umbilical 192, such as a wireline, a tether, tubing, and/or coiled tubing. As another example, shockwave generation device 190 may be an autonomous shockwave generation device that may be flowed into and/or within tubular conduit 42 without an attached umbilical. As yet another example, the shockwave generation device may form a portion of one or more SSPs 100 and may be referred to as a shockwave generation structure 180, as discussed in more detail herein with reference to FIG. 2. As additional examples, shockwave generation device 190 may include an explosive charge, such as a length of primer cord and/or a blast cap.

Figure 2:
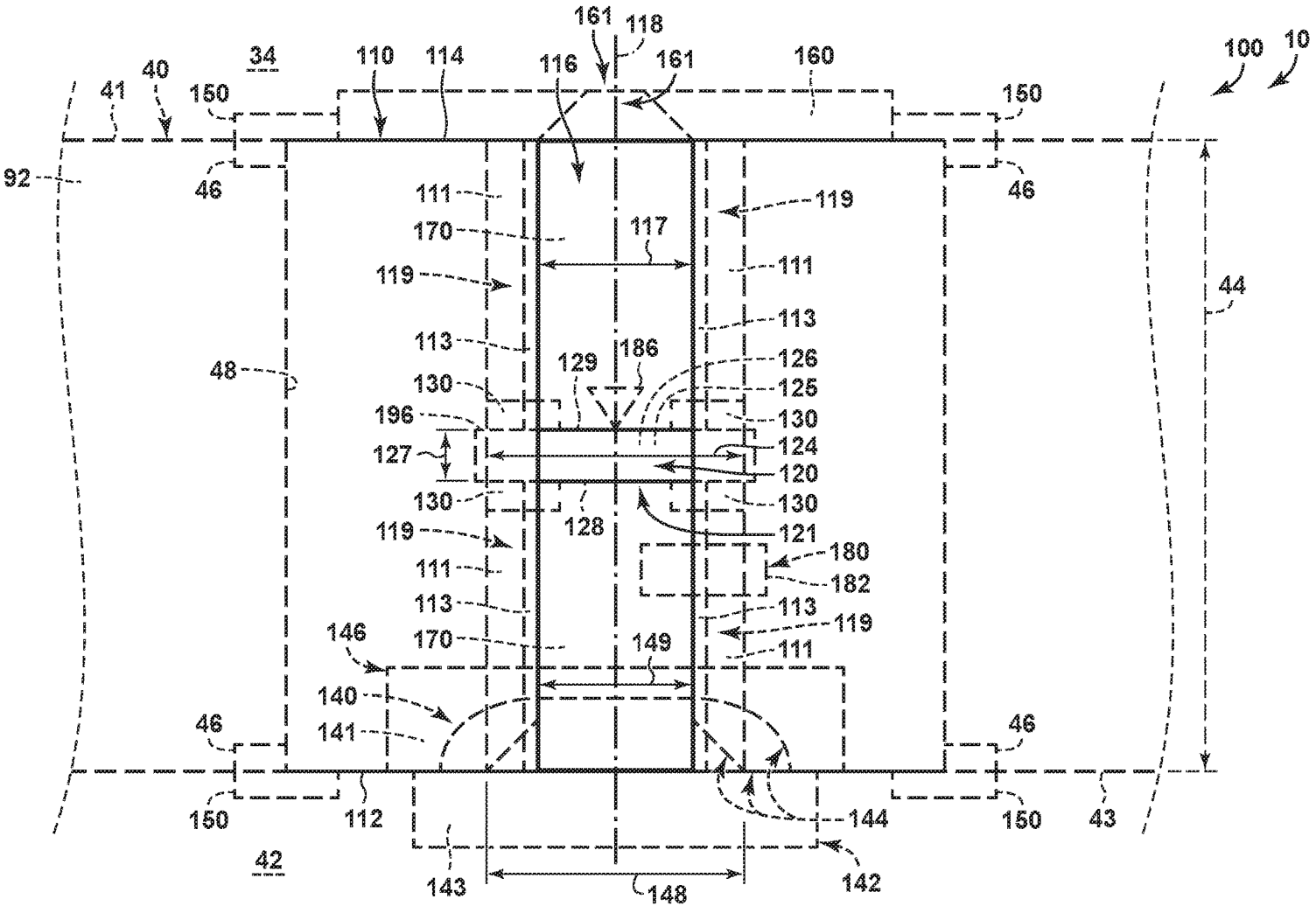
FIG. 2 is a schematic representation of examples of selective stimulation ports that may be included in and/or form a portion of wellbore tubulars according to the present disclosure.

FIG. 2 is a schematic representation of examples of selective stimulation ports (SSPs) 100, according to the present disclosure, that may be included in and/or form a portion of wellbore tubulars 40. SSPs 100 of FIG. 2 may be more detailed illustrations of SSPs 100 of FIG. 1, and any of the structures, functions, and/or features that are discussed and/or illustrated herein with reference to FIG. 2 may be included in and/or utilized with SSPs 100 of FIG. 1 without departing from the scope of the present disclosure. Similarly, any of the structures, functions, and/or features that are discussed and/or illustrated herein with reference to hydrocarbon wells 10 and/or wellbore tubulars 40 of FIG. 1 may be included in and/or utilized with SSPs 100 of FIG. 2 without departing from the scope of the present disclosure.

As illustrated in FIG. 2, SSPs 100 include an SSP body 110. SSP body 110 includes a conduit-facing region 112, which is configured to face toward tubular conduit 42 when SSP 100 is installed within wellbore tubular 40. Wellbore tubular 40 includes a tubular body 92 that defines an external surface 41 and an internal surface 43. External surface 41 also may be referred to herein as an external body surface 41 and/or as an outer body surface 41. Internal surface 43 also may be referred to herein as an internal body surface 43 and/or as an inner body surface 43 and may be referred to herein as defining tubular conduit 42.

SSP body 110 also includes a formation-facing region 114, which is configured to face toward subterranean formation 34 when the SSP is installed within the wellbore tubular and the wellbore tubular extends within the subterranean formation. SSP body 110 further includes and/or defines an SSP conduit 116, which extends between conduit-facing region 112 and formation-facing region 114. SSP conduit 116 may selectively establish a fluid flow path between tubular conduit 42 and subterranean formation 34.

SSP 100 also includes an isolation device 120. Isolation device 120 extends within and/or across SSP conduit 116 and is configured to selectively transition, or to be selectively transitioned, from a closed state 121, as illustrated in FIG. 2, to an open state. When isolation device 120 is in the closed state, the isolation device restricts, blocks, and/or occludes fluid flow within the SSP conduit, through the SSP conduit, and/or between tubular conduit 42 and subterranean formation 34 via the SSP conduit. Conversely, and when isolation device 120 is in the open state, the isolation device permits, facilitates, does not restrict, does not block, and/or does not occlude the fluid flow within the SSP conduit, through the SSP conduit, and/or between tubular conduit 42 and subterranean formation 34 via the SSP conduit. Transitioning isolation device 120 from the closed state to the open state also may be referred to herein as transitioning SSP 100 from the closed state to the open state and/or as transitioning SSP conduit 116 from the closed state to the open state.

Isolation device 120 is configured to transition from the closed state to the open state responsive to, or responsive to experiencing, a shockwave that has greater than a threshold shockwave intensity. A shockwave that has greater than the threshold shockwave intensity may be referred to herein as a threshold shockwave, a triggering shockwave, and/or a transitioning shockwave. The shockwave may be generated by a shockwave generation structure 180, which may be present within and/or may form a portion of SSP 100 and is illustrated in FIG. 2, and/or by a shockwave generation device 190, which may be separated and/or distinct from SSP 100 and is illustrated in FIG. 1. The shockwave may be generated within a wellbore fluid 22, as illustrated in FIG. 1, and may be propagated from the shockwave generation device or the shockwave generation structure to the SSP via the wellbore fluid. Examples of the wellbore fluid include reservoir fluid 36 and/or a stimulant fluid, as discussed in more detail herein.

Returning to FIG. 2, SSP 100 further may include a retention device 130.

Retention device 130 may be configured to couple, or operatively couple, isolation device 120 to SSP body 110, such as to retain the isolation device in the closed state prior to receipt of the threshold shockwave. Retention device 130 optionally may be configured to permit and/or facilitate transitioning of isolation device 120 from the closed state to the open state responsive to receipt of the threshold shockwave.

SSP 100 also may include a sealing device seat 140. Sealing device seat 140 may be defined by conduit-facing region 112 of SSP body 110. In addition, sealing device seat 140 may be shaped to form a fluid seal 144 with a sealing device 142. The sealing device may be positioned on and/or in contact with the sealing device seat, such as to form the fluid seal, by flowing, via tubular conduit 42, into engagement with the sealing device seat. When the sealing device is engaged with the sealing device seat to form the fluid seal, the sealing device restricts, or selectively restricts, fluid flow from tubular conduit 42 to subterranean formation 34 via SSP conduit 116.

As discussed in more detail herein, wellbore tubulars 40 have a plurality of SSPs 100 operatively attached thereto prior to the wellbore tubular being located, placed, and/or positioned within the wellbore. The SSPs may be in the closed state during operative attachment to the wellbore tubular and/or while the wellbore tubular is positioned within the wellbore. Subsequently, shockwave generation structure 180 of FIG. 2 and/or shockwave generation device 190 of FIG. 1 may be utilized to generate the shockwave within the wellbore fluid that extends within the tubular conduit and/or that extends in fluid communication with the isolation device. The shockwave may propagate within the wellbore fluid and/or to the SSP and may be received and/or experienced by at least a threshold fraction of the plurality of SSPs.

However, the shockwave also is attenuated, is dampened, and/or decays as it propagates within the wellbore fluid. Thus, the shockwave will only have greater than the threshold shockwave intensity within a specific region of the wellbore tubular, and the threshold fraction of the plurality of SSPs will only transition from the closed state to the open state if the threshold fraction of the plurality of SSPs is located within this specific region of the wellbore tubular (i.e., if the shockwave has greater than the threshold shockwave intensity when the shockwave reaches, or contacts, the threshold fraction of the plurality of SSPs). Thus, individual, selected, and/or specific SSPs 100 may be transitioned from the closed state to the open state without transitioning, or concurrently transitioning, other SSPs that are outside, or that are not within, the specific region of the wellbore tubular. Such a configuration may permit SSPs 100, according to the present disclosure, to be more selectively actuated, via the shockwave, when compared to more universally applied pressure spikes, which may act upon an entirety of a length of the wellbore tubular.

The shockwave may be attenuated, within the wellbore fluid, at any suitable shockwave attenuation rate. As examples, the shockwave attenuation rate may be at least 1 megapascal per meter (MPa/m), at least 2 MPa/m, at least 4 MPa/m, at least 6 MPa/m, at least 8 MPa/m, at least 10 MPa/m, at least 12 MPa/m, at least 14 MPa/m, at least 16 MPa/m, at least 18 MPa/m, or at least 20 MPa/m.

The shockwave also may have any suitable (non-zero) shockwave intensity, which also may be referred to herein as a peak shockwave pressure and/or as a maximum shockwave pressure. As examples, the shockwave intensity may be at least 100 megapascals (MPa), at least 110 MPa, at least 120 MPa, at least 130 MPa, at least 140 MPa, at least 150 MPa, at least 160 MPa, at least 170 MPa, at least 180 MPa, at least 190 MPa, at least 200 MPa, at least 250 MPa, at least 300 MPa, at least 400 MPa, or at least 500 MPa.

Similarly, the shockwave may have any suitable (non-zero) duration, which also may be referred to herein as a maximum duration, a shockwave duration, and/or a maximum shockwave duration. Examples of the maximum duration include durations of less than 1 second, less than 0.9 seconds, less than 0.8 seconds, less than 0.7 seconds, less than 0.6 seconds, less than 0.5 seconds, less than 0.4 seconds, less than 0.3 seconds, less than 0.2 seconds, less than 0.1 seconds, less than 0.05 seconds, or less than 0.01 seconds. The maximum duration may be a maximum period of time during which the shockwave has greater than the threshold shockwave intensity within the wellbore tubular. Additionally or alternatively, the maximum duration may be a maximum period of time during which the shockwave has a shockwave intensity of greater than 68.9 MPa (10,000 pounds per square inch) within the wellbore tubular.

With the above in mind, the shockwave may exhibit greater than the threshold shockwave intensity over only a fraction of a length of the wellbore tubular and only for a brief period of time. As examples, the shockwave may exhibit greater than the threshold shockwave intensity over a maximum effective distance of 1 meter, 2 meters, 3 meters, 4 meters, 5 meters, 6 meters, 7 meters, 8 meters, 10 meters, 15 meters, 20 meters, or 30 meters along a length of the tubular conduit. Stated another way, the shockwave may have a peak shockwave intensity proximate an origination point thereof (i.e., proximate the shockwave generation device and/or the shockwave generation structure). The threshold shockwave intensity may be less than, or less than a threshold fraction of, the peak shockwave intensity, and an intensity of the shockwave may be less than the threshold shockwave intensity at distances that are greater than the maximum effective distance from the origination point.

The shockwave generation structure and/or the shockwave generation device may be configured such that the shockwave emanates symmetrically, or at least substantially symmetrically, therefrom. Stated another way, the shockwave generation structure and/or the shockwave generation device may be configured such that the shockwave emanates isotropically, or at least substantially isotropically, therefrom. Stated yet another way, the shockwave generation structure and/or the shockwave generation device may be configured such that the shockwave is symmetric, or at least substantially symmetric, within a given transverse cross-section of the wellbore tubular.

SSP body 110 may include any suitable structure that may have, include, and/or define conduit-facing region 112, formation-facing region 114, and/or SSP conduit 116. In addition, SSP body 110 may be formed from any suitable material, and the SSP body may be formed from a different material than a material of wellbore tubular 40, than a material of a majority of wellbore tubular 40, and/or than a material that comprises a portion of wellbore tubular 40 that is operatively attached to SSP body 110.

It is within the scope of the present disclosure that SSP body 110 may be a single-piece, or monolithic, SSP body 110. Alternatively, it also is within the scope of the present disclosure that SSP body 110 may be a composite SSP body 110 that may be formed from a plurality of distinct, separate, and/or chemically different components.

As illustrated in dashed lines in FIG. 2, SSP body 110 may be separate from, distinct from, and/or may be formed from a different material than wellbore tubular 40. Under these conditions, SSP body 110 may be configured to be operatively attached to the wellbore tubular with the SSP body extending through a tubular aperture 48 that may be defined within the wellbore tubular and/or that may extend between tubular conduit 42 and external surface 41 of the wellbore tubular. In such a configuration, SSP 100 and/or SSP body 110 thereof may include a projecting region 150 that may be configured to project past tubular aperture 48. The projecting region may project transverse, or perpendicular to, a central axis 118 of SSP conduit 116. Stated another way, at least a portion of SSP 100 and/or SSP body 110 thereof may have a maximum outer diameter that is greater than an inner diameter of tubular aperture 48. In such a configuration, wellbore tubular 40 may define a recess 46 that may be configured to receive projecting region 150.

Additionally or alternatively, SSP body 110 also may be at least partially defined by wellbore tubular 40 and/or by any suitable component thereof. As examples, SSP body 110 may be partially, or even completely, defined by casing string 50, casing segment 52, casing collar 54, blade centralizer 56, sleeve 58, and/or inter-casing tubing 60 of FIG. 1.

As illustrated in FIG. 2, SSP 100 and/or SSP body 110 thereof may be configured such that the SSP does not extend into tubular conduit 42 and/or such that the SSP does not extend, or project, past internal surface 43 of wellbore tubular 40, and/or such that the SSP does not block, occlude, and/or restrict fluid flow within the tubular conduit. Stated another way, conduit-facing region 112 of SSP body 110 and/or sealing device seat 140 of SSP 100 may be flush with internal surface 43 and/or may be recessed within tubular aperture 48, when present. Thus, SSP 100 may not block and/or restrict fluid flow within tubular conduit 42 and/or the presence of SSP 100 may not change a transverse cross-sectional area for fluid flow within tubular conduit 42.

Stated yet another way, a transverse cross-sectional area of a portion of the tubular conduit that includes one or more SSPs may be at least a threshold fraction of a transverse cross-sectional area of a portion of the tubular conduit that does not include an SSP, or any SSPs. Examples of the threshold fraction of the transverse cross-sectional area include threshold fractions of at least 80 percent, at least 85 percent, at least 90 percent, at least 92.5 percent, at least 95 percent, at least 96 percent, at least 97 percent, at least 98 percent, or at least 99 percent of the transverse cross-sectional area.

As discussed in more detail herein, conventional stimulation methods may utilize a shape charge perforation device to create, generate, and/or define one or more perforations within a casing string that extends within a subterranean formation. As also discussed, such perforations may not be symmetrical, may not be round, and/or may not form a fluid-tight seal with a sealing device, such as a ball sealer. In addition, and as also discussed, stimulation of the subterranean formation may include flowing a stimulant fluid that may include particulate material through the perforations, which may be abrasive to the perforations, and/or flowing a stimulant fluid that may include a corrosive material through the perforations, which may corrode the perforations. Additionally or alternatively, long-term flow of the reservoir fluid through the perforations also may corrode the perforations. Thus, flow of the stimulant fluid through the perforations further may change the shape of the perforations. This change in shape further may decrease an ability for the perforations to form a fluid-tight seal with the sealing device and/or may cause an increase in a cross-sectional area for fluid flow through the perforations, thereby increasing a flow rate of the stimulant fluid through the perforations for a given pressure drop thereacross. Either situation may be detrimental to, may decrease a reliability of, and/or may increase a complexity of stimulation operations that utilize perforations created by shape charge perforation devices.

With this in mind, SSPs 100 according to the present disclosure may include an SSP body 110 that is at least partially erosion-resistant and/or corrosion-resistant, or at least more erosion-resistant and/or corrosion-resistant than wellbore tubular 40. As an example, SSP body 110 may include and/or be an erosion-resistant SSP body that may be configured to resist erosion by the particulate material. As a more specific example, the SSP body may include an erosion-resistant material that is more resistant to erosion than a material forming a portion of the wellbore tubular to which the SSP is attached. The erosion-resistant material may form at least a portion of any suitable region and/or component of SSP body 110. As examples, the erosion-resistant material may form at least a portion of conduit-facing region 112, formation-facing region 114, sealing device seat 140, and/or an internal portion of SSP body 110 that defines SSP conduit 116.

It is within the scope of the present disclosure that the erosion-resistant material may form and/or define the entire, or an entirety of, SSP body 110. Alternatively, it also is within the scope of the present disclosure that the erosion-resistant material may form only a portion, a subset, or less than an entirety of the SSP body and/or that the erosion-resistant material may be different from a material of a remainder of the SSP body. As an example, the erosion-resistant material may include and/or be an erosion-resistant sleeve 111 that is operatively attached to the SSP body and/or an erosion-resistant coating 113 that covers at least a portion of the SSP body. As another example, the erosion-resistant material may include and/or be an erosion-resistant layer, coating, and/or ring that is operatively attached to and/or forms all or a portion of sealing device seat 140.

As another example, SSP body 110 may include and/or be a corrosion-resistant SSP body that may be configured to resist corrosion by, within, or while in contact with, the stimulant fluid, such as a stimulant fluid that includes, or is, an acid. As a more specific example, the SSP body may include a corrosion-resistant material that is more resistant to corrosion than a material forming a portion of the wellbore tubular to which the SSP is attached. The corrosion-resistant material may form at least a portion of any suitable region and/or component of SSP body 110. As examples, the corrosion-resistant material may form at least a portion of conduit-facing region 112, formation-facing region 114, sealing device seat 140, and/or an internal portion of SSP body 110 that defines SSP conduit 116.

It is within the scope of the present disclosure that the corrosion-resistant material may form and/or define the entire, or an entirety of, the SSP body. Alternatively, it is also within the scope of the present disclosure that the corrosion-resistant material may form only a portion, a subset, or less than an entirety of the SSP body and/or that the corrosion-resistant material may be different from a material of a remainder of the SSP body. As an example, the corrosion-resistant material may include and/or be a corrosion-resistant sleeve 111 that is operatively attached to the SSP body and/or a corrosion-resistant coating 113 that covers at least a portion of the SSP body. As another example, the corrosion-resistant material may include and/or be a corrosion-resistant layer, coating, and/or ring that is operatively attached to and/or forms all or a portion of sealing device seat 140.

Examples of the erosion-resistant material, of the corrosion-resistant material, and/or of other materials that may be included within SSP body 110 include one or more of a nitride, a nitride coating, a boride, a boride coating, a carbide, a carbide coating, a tungsten carbide, a tungsten carbide coating, a self-hardening alloy, a work-hardening alloy, high manganese work-hardening steel, a ceramic, a high strength steel, a diamond-like material, a diamond-like coating, a heat-treated material, a magnetic material, and/or a radioactive material. When SSP body 110 includes and/or is formed from the magnetic material and/or the radioactive material, shockwave generation device 190 of FIG. 1 may be configured to detect and/or determine a proximity between SSP 100 and the shockwave generation device by detecting the presence of, or proximity to, the magnetic material and/or the radioactive material.

SSP conduit 116 may include and/or be any suitable fluid conduit that extends between the conduit-facing region and the formation-facing region and/or that may be configured to convey a fluid between the tubular conduit and the subterranean formation when isolation device 120 is in the open state. In addition, SSP conduit 116 may have any suitable inner diameter, cross-sectional area, and/or transverse cross-sectional area. As an example, SSP conduit 116 may include and/or be a cylindrical, or at least substantially cylindrical, SSP conduit.

The cylindrical SSP conduit may have a diameter of at least 0.1 centimeter (cm), at least 0.15 cm, at least 0.2 cm, at least 0.25 cm, at least 0.5 cm, at least 0.75 cm, at least 1 cm, at least 1.5 cm, at least 2 cm, at least 2.5 cm, at least 3 cm, or at least 3.5 cm. Additionally or alternatively, the cylindrical SSP conduit may have a diameter of less than 6 cm, less than 5.5 cm, less than 5 cm, less than 4.5 cm, less than 4 cm, less than 3.5 cm, less than 3 cm, or less than 2.5 cm.

Additionally or alternatively, the SSP conduit may have a diameter that is less than an average tubular conduit diameter of tubular conduit 42. As examples, the SSP conduit may have a diameter that is less than 20 percent, less than 15 percent, less than 10 percent, or less than 5 percent of the average tubular conduit diameter of tubular conduit 42.

When SSP conduit 116 is not the cylindrical SSP conduit, a transverse cross-sectional area of the SSP conduit may be comparable, or equal, to the cross-sectional areas of cylindrical SSP conduits that have any of the above-listed diameters and/or diameter ranges. In addition, and when SSP conduits 116 of the plurality of SSPs 100 have different and/or varying diameters, the plurality of SSPs may define an average SSP conduit diameter, and the average SSP conduit diameter may include any of the above-listed diameters.

Isolation device 120 may include and/or be any suitable structure that may extend within SSP conduit 116, that may selectively restrict fluid flow through the SSP conduit, and/or that may be configured to selectively transition from the closed state to the open state responsive to the threshold shockwave. In general, isolation device 120 may be adapted, configured, designed, and/or constructed only to exhibit a single, or irreversible, transition from the closed state to the open state. As examples, isolation device 120 may be configured to break apart, to be destroyed, to be displaced from, and/or to irreversibly separate from a remainder of SSP 100 and/or from SSP body 110 upon transitioning from the closed state to the open state.

Isolation device 120 may include and/or be formed from any suitable material. As examples, the isolation device may include and/or be formed from a magnetic material, a radioactive material, and/or an acid-soluble material. Additional examples of materials of isolation device 120 are disclosed herein. When isolation device 120 includes and/or is formed from the magnetic material and/or the radioactive material, these materials may be detected by shockwave generation device 190, as discussed herein.

As discussed, isolation device 120 may be configured to transition from the closed state to the open state responsive to the threshold shockwave, and examples of the threshold shockwave and the threshold shockwave intensity are disclosed herein. Isolation device 120 also may be configured to remain in the closed state, or to resist transitioning from the closed state to the open state, during, or despite, a static pressure differential thereacross. This static pressure differential may have a significant magnitude, and examples of the static pressure differential, which also may be referred to herein as a threshold static pressure differential, include pressure differentials of at least 40 MPa, at least 45 MPa, at least 50 MPa, at least 55 MPa, at least 60 MPa, at least 65 MPa, at least 68 MPa, at least 68.9 MPa, at least 70 MPa, at least 75 MPa, at least 80 MPa, at least 85 MPa, at least 90 MPa, at least 95 MPa, or at least 100 MPa.

Isolation device 120 may be positioned, located, and/or present at any suitable location within SSP 100 and/or within SSP conduit 116 thereof. As an example, and as illustrated in FIG. 2, isolation device 120 may be positioned within a central portion of SSP conduit 116, proximal a midpoint of a length of SSP conduit 116, and/or such that the isolation device is offset from conduit-facing region 112 and also from formation-facing region 114. As another example, isolation device 110 may be aligned with and/or proximal formation-facing region 114. As yet another example, isolation device 110 may be aligned with and/or proximal conduit-facing region 112.

Isolation device 120 also may have any suitable isolation device thickness 127, as illustrated in FIG. 2. As an example, isolation device thickness 127 may be less than a wellbore tubular thickness 44 of wellbore tubular 40. Both isolation device thickness 127 and wellbore tubular thickness 44 may be measured in a direction that is parallel to central axis 118 of SSP conduit 116.

SSP body 110 may include and/or define an isolation device recess 119, which may be configured to receive isolation device 120. Isolation device recess 119 may extend from conduit-facing region 112 of SSP body 110. Additionally or alternatively, isolation device recess 119 also may extend from formation-facing region 114 of SSP body 110. When SSP body 110 includes isolation device recess 119, retention device 130 may be configured to at least temporarily retain the isolation device within the isolation device recess.

Isolation device 120 also may have and/or define any suitable shape. As an example, a shape of an outer perimeter of isolation device 120 may be complementary to, or may correspond to, a transverse cross-sectional shape of isolation device recess 119, when present, and/or to a transverse cross-sectional shape of SSP conduit 116. As another example, isolation device 120 may include a conduit-facing side 128 and a formation-facing side 129, and the conduit-facing side and/or the formation-facing side may be planar, at least substantially planar, arcuate, partially spherical, partially parabolic, partially cylindrical, and/or partially hyperbolic. Stated another way, isolation device 120 may have a non-constant thickness as measured in a direction that extends between conduit-facing region 112 and formation-facing region 114 of SSP body 110 and/or as measured in a direction that is parallel to central axis 118.

In general, the shape of the isolation device may be selected such that the isolation device is shaped to resist at least a threshold static pressure differential between conduit-facing side 128 and formation-facing side 129 without damage thereto. Examples of the threshold static pressure differential are disclosed herein.

An example of isolation device 120 is an isolation disk 126. Isolation disk 126 may be configured to be retained within SSP 100 by retention device 130 when the isolation device is in the closed state. However, isolation disk 120 may be configured separate from a remainder of SSP 100 and/or to be displaced or otherwise conveyed into subterranean formation 34 in an intact, or at least substantially intact, state when the isolation device transitions to the open state. This may include the isolation disk being conveyed from formation-facing region 114 of SSP body 110 and/or being conveyed from a formation-facing end of SSP conduit 116, with the formation-facing end of the SSP conduit being defined by formation-facing region 114.

Isolation disk 126 may include any suitable material and/or materials of construction, examples of which include a metallic isolation disk that may be formed from one or more of steel, stainless steel, cast iron, a metal alloy, brass, and/or copper. When SSPs 100 include isolation disk 126, and as discussed in more detail herein, retention device 130 may be configured to selectively release the isolation disk from the SSP responsive to the threshold shockwave.

Another example of isolation device 120 is a frangible isolation device 120 that is formed from a frangible material. The frangible material may be configured to break apart, to be destroyed, and/or to disintegrate responsive to, responsive to experiencing, and/or responsive to receipt of the threshold shockwave. Such an isolation device also may be referred to herein as a frangible disk 125 and/or as a frangible isolation disk 125. Examples of the frangible material include a glass, a tempered glass, a ceramic, a frangible magnetic material, a frangible radioactive material, a frangible ceramic magnet, a frangible alloy, and/or an acrylic.

As discussed, frangible isolation devices 120, such as frangible disks 125, may be configured to break apart responsive to receipt of the threshold shockwave. As an example, such isolation devices may comprise a single piece prior to receipt of the threshold shockwave and may comprise a plurality of spaced-apart pieces subsequent to receipt of the threshold shockwave. As another example, and when the isolation device is in the closed state (i.e., prior to receipt of the threshold shockwave), the isolation device may define a first maximum dimension, such as an outer diameter 124. Conversely, and when the isolation device is in the open state (i.e., subsequent to receipt of the threshold shockwave), the isolation device may define a second maximum dimension that is less than the first maximum dimension.

As illustrated in dashed lines, SSP 100 may include a sealing structure 196. Sealing structure 196 may be configured to restrict fluid flow within SSP conduit 116 and past isolation device 120 when the isolation device is in the closed state. As examples, sealing structure 196 may be configured to form a fluid seal between isolation device 120 and SSP body 110 and/or between isolation device 120 and retention device 130. Examples of sealing structure 196 include any suitable elastomeric sealing structure, polymeric sealing structure, compliant sealing structure, flexible sealing structure, compressible sealing structure, a resin, an epoxy, an adhesive, a gasket, and/or an O-ring.

It is within the scope of the present disclosure that SSP 100 may include a single isolation device 120 or a plurality of isolation devices 120. As an example, SSP 100 may include a first isolation device 120, which may be configured to restrict fluid flow from conduit-facing region 112 and through SSP conduit 116, and a second isolation device 120, which may be configured to restrict fluid flow from formation-facing region 114 and through SSP conduit 116.

When SSP 100 includes the first isolation device and the second isolation device, an intermediate portion of SSP conduit 116 may extend between, or separate, the first isolation device and the second isolation device. Under these conditions, the first isolation device may be configured to resist at least a first threshold static pressure differential between the tubular conduit and the intermediate portion of the SSP conduit. Similarly, the second isolation device may be configured to resist at least a second threshold static pressure differential between the subterranean formation and the intermediate portion of the SSP conduit. Examples of the first threshold static pressure differential and of the second threshold static pressure differential are disclosed herein with reference to the threshold static pressure differential of isolation devices 120.

Retention device 130 may include and/or be any suitable structure that may be adapted, configured, shaped, and/or selected to couple the isolation device to the SSP body and/or to retain the isolation device in the closed state prior to receipt of the threshold shockwave. It is within the scope of the present disclosure that, responsive to receipt of the threshold shockwave, retention device 130 may be configured to release isolation device 120 from SSP 100, such as when isolation device 120 includes isolation disk 126. Under these conditions, retention device 130 may change, transition, and/or be deformed upon receipt of the threshold shockwave. As an example, retention device 130 may include at least one shear pin that shears, upon receipt of the threshold shockwave, to release the isolation device. As another example, retention device 130 may include at least one snap ring and corresponding groove, and the snap ring may be displaced from the groove, upon receipt of the threshold shockwave, to release the isolation device. As yet another example, retention device 130 may include a threaded retainer, and the threaded retainer may fail, upon receipt of the threshold shockwave, to release the isolation device.

Additionally or alternatively, it also is within the scope of the present disclosure that retention device 130 may be rigid, may be fixed, may be nonresponsive to (i.e. not damaged by) receipt of the threshold shockwave, and/or may not respond to the threshold shockwave, such as when isolation device 120 includes frangible disk 125. Under these conditions, isolation device 120 may fragment, fail, or otherwise be displaced from the retention device and the SSP body upon transitioning from the closed state to the open state.

At least a portion of retention device 130 may be separate and/or distinct from SSP body 110. Additionally or alternatively, at least a portion of retention device 130 may be defined by SSP body 110. As an example, isolation device recess 119 may form a portion of retention device 130 and/or may at least partially retain isolation device 120 within SSP 100.

Retention device 130 may include and/or be formed from any suitable material and/or materials, including a magnetic material and/or a radioactive material. Such materials may be detected by shockwave generation device 190, as discussed herein.

Sealing device seat 140 may include any suitable structure that may be defined by conduit-facing region 112 of SSP body 110 and/or that may be adapted, configured, designed, constructed, and/or shaped to form the fluid seal with the sealing device. In addition, sealing device seat 140 may have a preconfigured, pre-established, and/or preselected geometry, such as when the geometry of the sealing device seat is established prior to SSP 100 being operatively attached to wellbore tubular 40 and/or prior to the wellbore tubular being located, installed, and/or positioned within the subterranean formation. Sealing device seat 140 may be erosion-resistant, may be formed from the erosion-resistant material, may be corrosion-resistant, and/or may be formed from the corrosion-resistant material, as discussed herein. Additionally or alternatively, sealing device seat 140 may be defined by a seat body 146, which may form a portion of SSP body 110 and/or may be erosion-resistant, may be formed from the erosion-resistant material, may be corrosion-resistant, and/or may be formed from the corrosion-resistant material.

Sealing device seat 140 may have, define, and/or include any suitable shape, and the sealing device seat is illustrated in dashed lines in FIG. 2 to illustrate several of these potential shapes. In general, sealing device seat 140 may include and/or be a symmetrical sealing device seat. Examples of the sealing device seat and/or of a shape thereof include a partially spherical sealing device seat, a truncated spherical cap sealing device seat, a conic section sealing device seat, an at least partially cone-shaped sealing device seat, an at least partially funnel-shaped sealing device seat, and/or a tapered sealing device seat. It is within the scope of the present disclosure that the shape of the sealing device seat of each of the plurality of SSPs may be similar, or at least substantially similar. However, this is not required.

As an additional example, and as illustrated in FIG. 2, the sealing device seat may converge, within SSP body 110, from a first diameter 148, which is defined in conduit-facing region 112 of SSP body 110, to a second diameter 149, which is defined within SSP body 110. The first diameter may be greater than the second diameter, and the second diameter may approach, or be, an outer diameter 117 of SSP conduit 116, which also may be referred to herein as an SSP conduit diameter 117. However, this is not required to all embodiments.

As illustrated in FIG. 2, sealing device 142 may be operatively positioned and/or engaged with sealing device seat 140 to form fluid seal 144. An example of sealing device 142 includes a ball sealer 143. When sealing device 142 includes ball sealer 143, sealing device seat 140 also may be referred to herein as a ball sealer seat 141, and ball sealer seat 141 may have a ball sealer seat radius of curvature that is equal, or at least substantially equal, to a ball sealer radius of ball sealer 143.

As discussed, SSPs 100 may include and/or be associated with shockwave generation structure 180, which may be adapted, configured, designed, and/or constructed to generate the shockwave. Shockwave generation structure 180 may include and/or be any it) suitable structure. As examples, shockwave generation structure 180 may include a mechanical shockwave generation structure, such as may be configured to mechanically generate the shockwave, a chemical shockwave generation structure, such as may be configured to chemically generate the shockwave, and/or an explosive shockwave generation structure, and such as may be configured to explosively generate the shockwave. As illustrated, shockwave generation structure 180 may extend, at least partially, within SSP conduit 116; however, this is not required.

When SSPs 100 include shockwave generation structure 180, the SSPs further may include a triggering device 182, which may be configured to actuate the shockwave generation structure, such as to cause the shockwave generation structure to generate the shockwave. Examples of triggering device 182 include any suitable wireless, or wirelessly actuated, triggering device, remote, or remotely actuated, triggering device, and/or wired triggering device.

As illustrated in dashed lines in FIG. 2, SSP 100 further may include a transition assist structure 186. Transition assist structure 186 may be configured to assist and/or facilitate isolation device 120 transitioning from the closed state to the open state responsive to experiencing the threshold shockwave and may include any suitable structure. As an example, transition assist structure 186 may include and/or be a point load, on isolation device 120, that is configured to initiate failure of the isolation device responsive to receiving the threshold shockwave. As another example, transition assist structure 186 may include and/or be a weak point on and/or within isolation device 120 that is configured to initiate failure of the isolation device responsive to receiving the threshold shockwave.

As also illustrated in dashed lines in FIG. 2, SSP 100 may include a barrier material 170. Barrier material 170 may extend at least partially within SSP conduit 116 and may be configured to remain within the SSP conduit during installation of wellbore tubular 40 into the subterranean formation. Such a configuration may protect SSP 100 and/or isolation device 120 thereof from damage during the installation and/or may prevent foreign material from entering at least a portion of the SSP conduit during the installation. In addition, barrier material 170 also may be configured to automatically separate, such as by dissolving, from SSP 100 and/or from SSP conduit 116 thereof responsive, or subsequent, to fluid contact with the wellbore fluid.

Barrier material 170 may be placed and/or present within any suitable portion of SSP conduit 116. As an example, the barrier material may extend between isolation device 120 and conduit-facing region 112 of SSP body 110. As another example, the barrier material may extend between isolation device 120 and formation-facing region 114 of SSP body 110.

Barrier material 170 may include any suitable material and/or materials. As an example, the barrier material may be selected to be, or may be, soluble within the wellbore fluid. More specific examples of barrier material 170 include polyglycolic acid and/or polylactic acid.

As illustrated in dashed lines in FIG. 2, SSP 100 also may include a nozzle 160. Nozzle 160 may be configured to generate a fluid jet at formation-facing region 114 of SSP body 110 and/or at a formation-facing end of SSP conduit 116. The fluid jet may be generated responsive to fluid flow from tubular conduit 42 and/or into subterranean formation 34 via the SSP conduit.

Nozzle 160 may include any suitable structure. As an example, nozzle 160 may include and/or be a jet nozzle. As another example, nozzle 160 may include a restriction, or a restriction region, 161 that may be configured to accelerate the fluid flow. Similarly, nozzle 160 may be formed from any suitable material, examples of which are disclosed herein with reference to the erosion-resistant materials and/or the corrosion-resistant materials of SSP body 110.

Nozzle 160 may be present within any suitable portion of SSP 100 and/or within wellbore tubulars 40 that include SSP 100. As an example, nozzle 160 may be proximal, or may form a portion of, formation-facing region 114 of SSP body 110 and/or may be proximal, or may form a portion of, the formation-facing end of SSP conduit 116. As another example, nozzle 160 may be distal, or relatively distal, conduit-facing region 112 of SSP body 110 and/or a conduit-facing end of SSP conduit 116. As yet another example, nozzle 160 may extend outward from external surface 41 of tubular body 92 of wellbore tubular 40.

Figure 3:
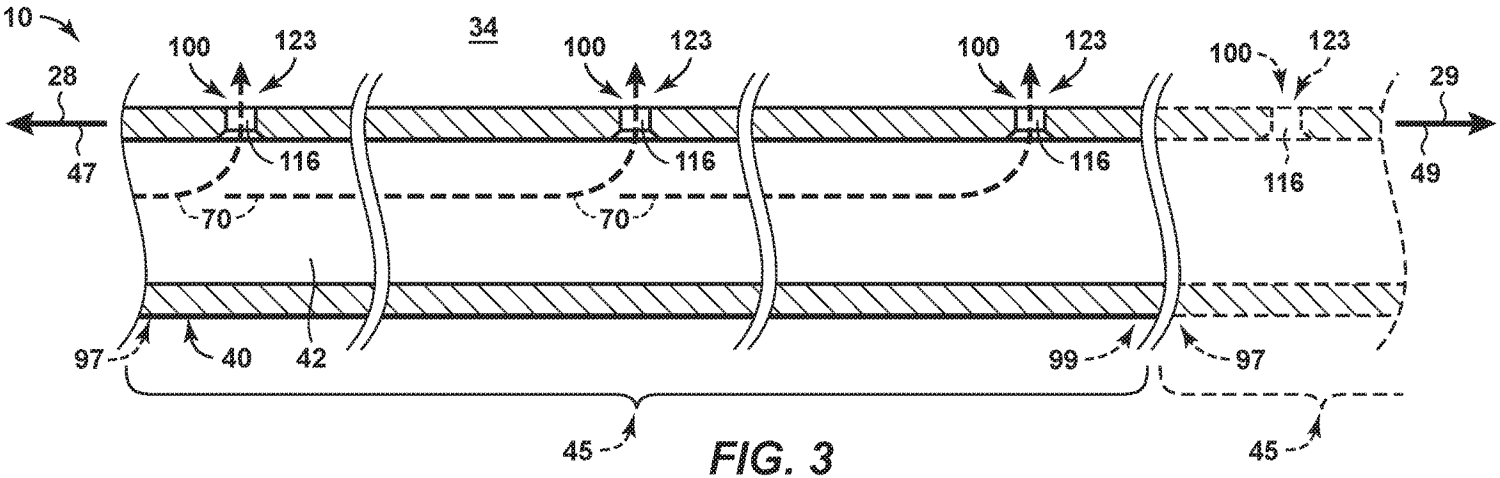
FIG. 3 is a schematic representation of examples of a wellbore tubular that includes a plurality of selective stimulation ports according to the present disclosure.
Figure 4:
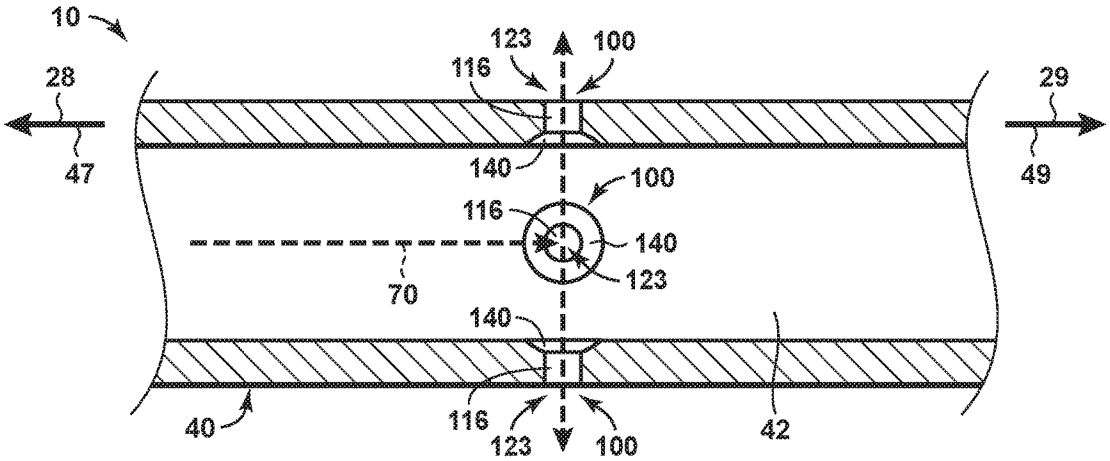
FIG. 4 is a schematic representation of examples of a wellbore tubular that includes a plurality of selective stimulation ports according to the present disclosure.

FIGS. 3-4 are schematic representations of examples of wellbore tubulars 40 that include a plurality of SSPs 100 according to the present disclosure. FIG. 3 illustrates SSPs 100 as being spaced apart along a length, along a longitudinal length, along an elongate axis, and/or along a longitudinal axis of wellbore tubular 40. These SSPs 100 also may be referred to herein as a plurality of longitudinally spaced SSPs 100. FIG. 4 illustrates SSPs 100 as being spaced apart around a transverse cross-section of wellbore tubular 40. These SSPs 100 also may be referred to herein as a plurality of radially spaced SSPs 100. Wellbore tubulars 40 of FIGS. 3-4 may include and/or be more detailed and/or different illustrations of wellbore tubulars 40 of FIGS. 1-2, and any of the structures, functions, and/or features that are to discussed and/or illustrated herein with reference to FIGS. 3-4 may be included in and/or utilized with wellbore tubulars 40 of FIGS. 1-2 without departing from the scope of the present disclosure. Similarly, any of the structures, functions, and/or features that are discussed and/or illustrated herein with reference to hydrocarbon wells 10 and/or wellbore tubulars 40 of FIGS. 1-2 may be included in and/or utilized with wellbore tubulars 40 of FIGS. 3-4 without departing from the scope of the present disclosure.

With reference to the plurality of longitudinally spaced SSPs of FIG. 3, each of the plurality of longitudinally spaced SSPs may have and/or define a minimum SSP conduit cross-sectional area 123. As illustrated in solid lines, the minimum SSP conduit cross-sectional area may vary, or vary systematically, with location along the length of wellbore tubular 40. Alternatively, and as illustrated in dashed lens, the minimum SSP conduit cross-sectional of each of the plurality of longitudinally spaced SSPs may be the same, or at least substantially the same, as the minimum SSP conduit cross-sectional area of a remainder of the plurality of longitudinally spaced SSPs.

When minimum SSP conduit cross-sectional area 123 varies with location along the length of wellbore tubular 40, the variation may define a preselected area distribution, or variation. As an example, the wellbore tubular may include an uphole tubular end 47 and a downhole tubular end 49, and the minimum SSP conduit cross-sectional area may increase systematically, or even monotonically, from the uphole tubular end to the downhole tubular end. Such a configuration may provide for equal, or at least substantially equal, flow rates of a stimulant fluid 70 through the plurality of longitudinally spaced SSPs when the plurality of longitudinally spaced SSPs is in the open state despite variations in a resistance to flow between a source of the stimulant fluid and each SSP of the plurality of longitudinally spaced SSPs.

As another example, wellbore tubular 40 may include a plurality of stimulation zones 45, and each of the plurality of stimulation zones may include a respective subset of the plurality of longitudinally spaced SSPs. Under these conditions, each stimulation zone may include an uphole zone end 97 and a downhole zone end 99, and the minimum conduit cross-sectional area may increase systematically, or even monotonically, from the uphole zone end to the downhole zone end. Such a configuration may permit the concurrent flow rates of stimulant fluid 70 through each SSP in a given stimulation zone 45 to be equal, or at least substantially equal, despite variations in the resistance to flow between the source of the stimulant fluid and the various SSPs in the given stimulation zone.

Stated another way, the variation in minimum SSP conduit cross-sectional area 123 of each SSP in the plurality of longitudinally spaced SSPs may be predetermined, preselected, and/or predefined. As an example, the minimum SSP conduit cross-sectional areas may be selected to provide an at least substantially equal flow rate of stimulant fluid 70 from tubular conduit 42 and into subterranean formation 34 via each SSP conduit 116 of each SSP 100 in the plurality of longitudinally spaced SSPs regardless of a location of the SSP along the longitudinal length of the wellbore tubular. Such a configuration may provide for equal, or at least substantially equal, stimulation of all regions of the subterranean formation via the plurality of longitudinally spaced SSPs.

As another example, the minimum SSP conduit cross-sectional areas also may be selected to provide a purposefully different flow rate of the stimulant fluid from the tubular conduit into the subterranean formation and through at least one SSP 100 of the plurality of longitudinally spaced SSPs when compared to at least one other SSP 100 in the plurality of longitudinally spaced SSPs. Such a configuration may permit purposeful and/or directed control of the stimulation of different regions of the subterranean formation via the plurality of longitudinally spaced SSPs, such as to permit certain region(s) to be stimulated more, or to a greater extent, than other region(s).

As yet another example, the minimum SSP conduit cross-sectional areas also may be selected to provide an equal, or at least substantially equal, flow rate of a reservoir fluid from the subterranean formation and into the tubular conduit via a respective SSP conduit 116 of each of the plurality of longitudinally spaced SSPs. Such a configuration may provide for equal, or at least substantially equal, production of the reservoir fluid from all regions of the subterranean formation subsequent to stimulation of the subterranean formation.

The minimum SSP conduit cross-sectional areas may be selected based, at least in part, on any suitable criteria. As examples, the minimum SSP conduit cross-sectional area may be selected based, at least in part, on one or more of a desired flow rate of the stimulant fluid through a given SSP conduit, a projected density of the stimulant fluid, a density of the stimulant fluid, a projected viscosity of the stimulant fluid, a viscosity of the stimulant fluid, a spacing between adjacent SSPs 100 in the plurality of longitudinally spaced SSPs, a projected pressure differential across each SSP 100 in the plurality of longitudinally spaced SSPs, a pressure differential across each SSP 100 in the plurality of longitudinally spaced SSPs, a projected composition of the stimulant fluid, a composition of the stimulant fluid, a projected slurry content of the stimulant fluid, and/or a slurry content of the stimulant fluid.

Examples of the stimulant fluid include a water-based stimulant fluid, an oil-based stimulant fluid, an acid, and/or a fracturing fluid. The stimulant fluid may include a proppant and/or an abrasive material, such as sand.

The plurality of longitudinally spaced SSPs may be spaced apart in any suitable manner and/or by any suitable distance, with this distance being measured along a length, or longitudinal axis, of the wellbore tubular. As examples, each of the plurality of longitudinally spaced SSPs may be spaced apart from a remainder of the plurality of longitudinally spaced SSPs by a distance of at least 1 meter, at least 2 meters, at least 3 meters, at least 4 meters, at least 6 meters, at least 7.5 meters, at least 10 meters, at least 15 meters, or at least 20 meters. Additionally or alternatively, each of the plurality of longitudinally spaced SSPs may be spaced apart from a remainder of the plurality of longitudinally spaced SSPs by a distance of less than 100 meters, less than 80 meters, less than 60 meters, less than 50 meters, less than 40 meters, less than 30 meters, or less than 20 meters. Additionally or alternatively, the wellbore tubular may include at least one SSP for every 25 meters, for every 50 meters, for every 75 meters, for every 100 meters, for every 125 meters, 150 meters, for every 175 meters, and/or for every 200 meters of wellbore tubular length.

When wellbore tubular 40 includes the plurality of radially spaced SSPs 100, and as illustrated in FIG. 4, the plurality of radially spaced SSPs may extend, be distributed, and/or be spaced apart around a perimeter, a periphery, and/or an external periphery of the wellbore tubular. As an example, and as illustrated, the plurality of radially spaced SSPs may extend within a single transverse cross-section of the wellbore tubular; however, this is not required. As an example, the plurality of radially spaced SSPs may extend along, or be located within, less than a threshold fraction of a longitudinal length of the wellbore tubular. Examples of the threshold fraction of the longitudinal length of the wellbore tubular include threshold fractions of less than 4 meters, less than 3 meters, less than 2 meters, or less than 1 meter.

Regardless of the exact configuration, the plurality of radially spaced SSPs may be positioned such that the threshold shockwave, or a single threshold shockwave, transitions each of the plurality of radially spaced SSPs from the closed state to the open state. Stated another way, the plurality of radially spaced SSPs may be positioned such that each of the plurality of radially spaced SSPs transitions from the closed state to the open state responsive to the threshold shockwave, responsive to the same threshold shockwave, and/or responsive to a single threshold shockwave. In addition, the plurality of radially spaced SSPs also may be positioned such that a stimulant fluid 70 enters SSP conduits 116 thereof traveling in a radial, or at least substantially radial, direction due to a lack of fluid flow, or at least substantial fluid flow, within tubular conduit 42 and past the plurality of radially spaced SSPs. Such a configuration may decrease, or may decrease a potential for, wear of sealing device seats 140 that may be associated with each of the plurality of radially spaced SSPs 100.

As illustrated, the plurality of radially spaced SSPs may be evenly and/or symmetrically spaced apart around the transverse cross-section of the wellbore tubular. However, this is not required.

When wellbore tubulars 40 include the plurality of radially spaced SSPs 100, each of the plurality of radially spaced SSPs may have, define, and/or include a minimum SSP conduit cross-sectional area 123; and the minimum SSP conduit cross-sectional area of each of the plurality of radially spaced SSPs may be equal, or at least substantially equal, to a minimum SSP conduit cross-sectional area 123 of a remainder of the plurality of radially spaced SSPs. Such a configuration may provide equal, or at least substantially equal, stimulation of the subterranean formation via each of the plurality of radially spaced SSPs.

The plurality of radially spaced SSPs 100 may include any suitable number of SSPs. As examples, the plurality of radially spaced SSPs may include at least 2, at least 3, at least 4, at least 5, at least 6, at least 7, at least 8, at least 9, or at least 10 SSPs 100. Additionally or alternatively, the plurality of radially spaced SSPs also may include fewer than 20, fewer than 15, fewer than 10, fewer than 8, fewer than 6, or fewer than 5 SSPs.

Figure 5:
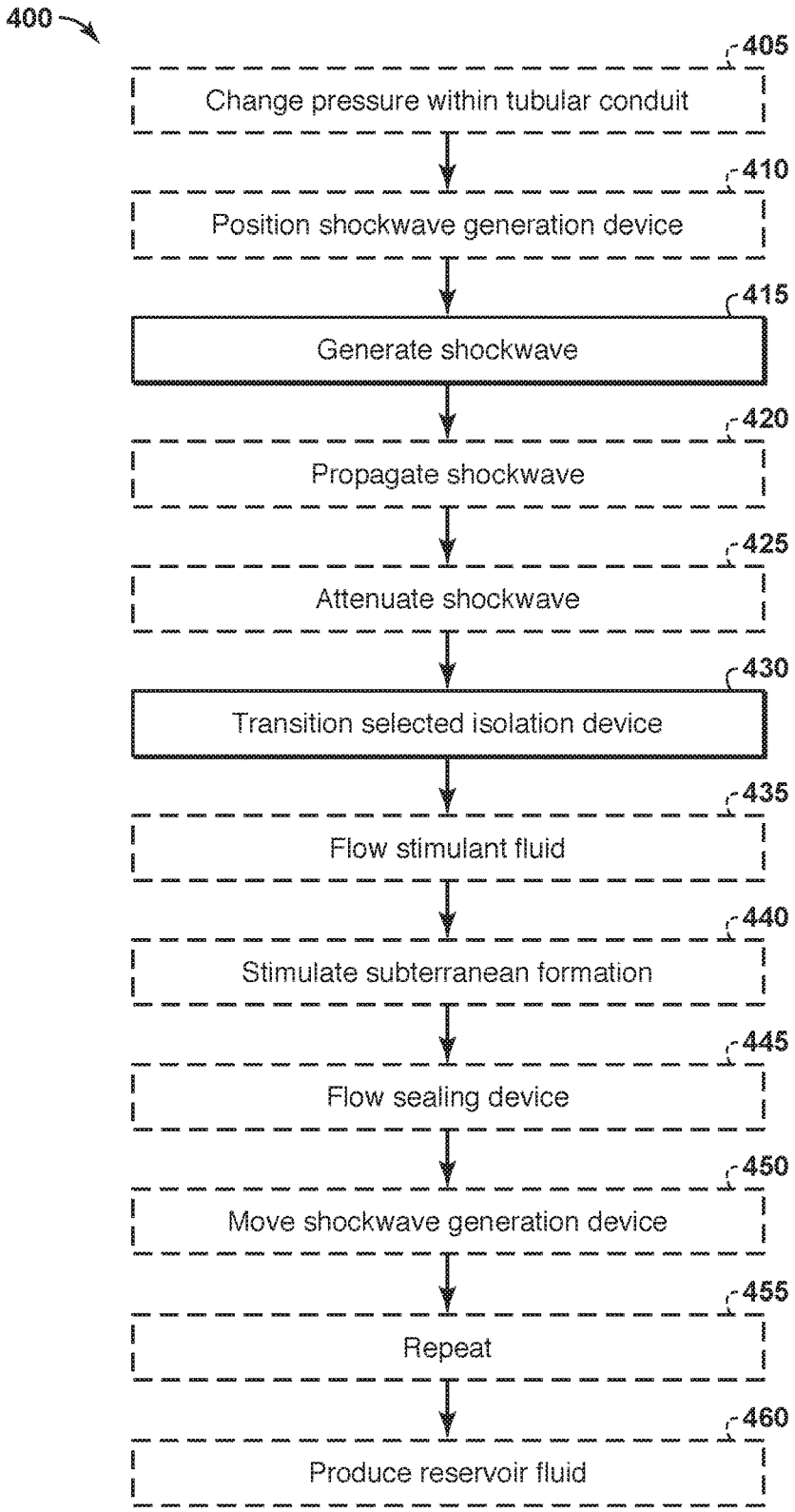
FIG. 5 is a flowchart depicting methods, according to the present disclosure, of stimulating a subterranean formation.

FIG. 5 is a flowchart depicting methods 400, according to the present disclosure, of stimulating a subterranean formation. FIGS. 6-10 are schematic representations of portions of a process flow 310 for stimulating a subterranean formation, such as via utilizing wellbore tubulars 40 and/or methods 400 according to the present disclosure. As illustrated in process flow 310 of FIGS. 6-10, a wellbore tubular 40, which may define a tubular conduit 42 and/or may be utilized to perform methods 400, may include a plurality of selective stimulation ports (SSPs) 100. The wellbore tubular of FIGS. 6-10 may include any of the structures, functions, and/or features of wellbore tubular 40 of any of FIGS. 1-4.

As illustrated in FIG. 5, methods 400 may include changing a pressure within the tubular conduit at 405 and/or positioning a shockwave generation device at 410. Methods 400 include generating a shockwave at 415 and may include propagating the shockwave at 420 and/or attenuating the shockwave at 425. Methods 400 further include transitioning a selected isolation device at 430 and may include flowing a stimulant fluid at 435, stimulating a subterranean formation at 440, and/or flowing a sealing device at 445. Methods 400 further may include moving the shockwave generation device at 450, repeating at least a portion of the methods at 455, and/or producing a reservoir fluid at 460.

Changing the pressure within the tubular conduit at 405 may include increasing a pressure within the tubular conduit. Additionally or alternatively, the changing at 405 also may include decreasing the pressure within the tubular conduit.

Figure 6:
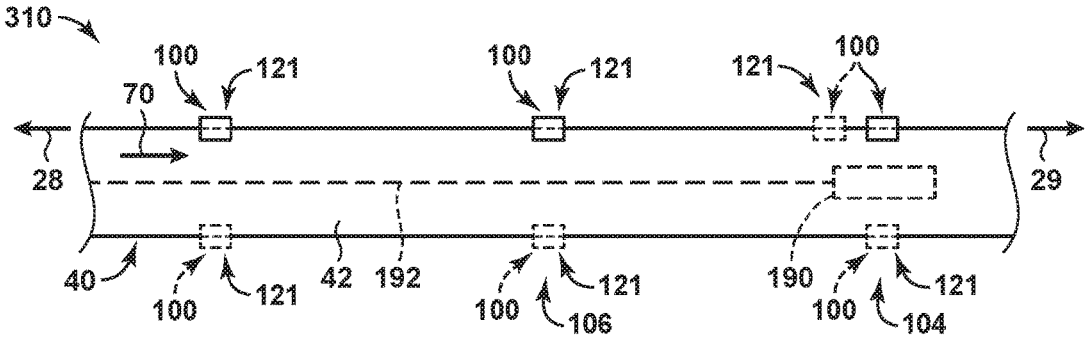
FIG. 6 is a schematic representation of a portion of a process flow for stimulating a subterranean formation utilizing the wellbore tubulars and/or methods according to the present disclosure.

When the changing at 405 includes increasing the pressure within the tubular conduit, the increasing may include pressurizing with a stimulant fluid and/or pressurizing to at least a threshold stimulation pressure. As an example, the increasing the pressure may include increasing to permit and/or facilitate the stimulating at 440. This is illustrated in FIG. 6, where a stimulant fluid 70 is provided to tubular conduit 42 to pressurize the tubular conduit. As illustrated, and during the pressurizing at 405, each SSP 100 may be in a closed state 121; however, this is not required. As an example, one or more of the SSPs may be in an open state but may have a sealing device operatively received on a sealing device seat thereof, as discussed in more detail herein. SSPs 100 that experience the threshold stimulation pressure generally are configured to restrict, block, and/or occlude fluid flow therethrough during the changing the pressure at 405. Examples of the threshold stimulation pressure include pressures, static pressures, or static stimulation pressures of at least 10 MPa, at least 15 MPa, at least 20 MPa, at least 25 MPa, at least 30 MPa, at least 35 MPa, at least 40 MPa, at least 45 MPa, at least 50 MPa, at least 55 MPa, or at least 60 MPa. Examples of the stimulant fluid are disclosed herein.

When the changing at 405 includes decreasing the pressure within the tubular conduit, the decreasing may include at least partially evacuating the tubular conduit and/or removing at least a portion, a majority, or even substantially all liquid from the tubular conduit. As an example, decreasing the pressure may include decreasing to permit and/or facilitate an inrush of reservoir fluid into the tubular conduit subsequent to the transitioning at 430. Such an inrush of reservoir fluid may flush, clear, and/or otherwise remove debris and/or particulate matter from the subterranean formation, thereby decreasing a resistance to fluid flow through the subterranean formation.

As discussed, the SSPs may be configured to remain in a closed state and/or to resist transitioning from the closed state to an open state when a pressure differential across an isolation device thereof is less than a threshold static pressure differential. In general, the threshold static pressure differential is greater than the threshold stimulation pressure and/or is greater than a pressure differential across the isolation device that may be generated during the changing at 405 and/or prior to the generating at 415. Examples of pressure differentials that may be generated prior to the generating at 415 include external pressure swings during running of the wellbore tubular, pressure differentials generated during wellbore tubular pressure testing, pressure differentials generated during stimulation of the subterranean formation, and/or pressure differentials generated during evacuation of all fluids from the wellbore tubular, such as to generate an underbalanced condition. As such, methods 400 further may include retaining the isolation device in the closed state during the changing at 405 and/or prior to the generating at 415. Examples of the threshold static pressure differential are disclosed herein.

Positioning the shockwave generation device at 410 may be accomplished in any suitable manner. As an example, and as discussed, the shockwave generation device may be separate and/or spaced apart from a selected fraction of the plurality of SSPs and/or may be present within the tubular conduit. Under these conditions, the positioning at 410 may include flowing the shockwave generation device in a downhole direction and/or into proximity with the selected fraction of the plurality of SSPs. This may include flowing from a surface region, such as surface region 30 of FIG. 1, and/or flowing along the tubular conduit. Additionally, or alternatively, the positioning at 410 also may include moving the shockwave generation device in an uphole direction, such as via and/or utilizing an umbilical.

An example of positioning shockwave generation device 190 is illustrated in dashed lines in FIG. 6. Therein, shockwave generation device 190 is positioned proximal a selected fraction 104 of the plurality of SSPs 100. In the example of FIG. 6, selected fraction 104 includes at least one SSP 100, as illustrated in solid lines, and may include one or more additional SSPs 100, as illustrated in dashed lines. As also illustrated in dashed lines in FIG. 6, shockwave generation device 190 may include and/or be an umbilical-attached shockwave generation device 190, which is operatively attached to an umbilical 192, or an autonomous shockwave generation device 190, which is not attached to the umbilical. The shockwave generation device may be flowed in a downhole direction 29 with and/or via stimulant fluid 70. Additionally or alternatively, the shockwave generation device may be moved and/or pulled in an uphole direction 28 with and/or via umbilical 192.

The positioning at 410 further may include detecting a proximity of the shockwave generation device to the SSP. This may include detecting one or more properties of the SSP, detecting a material of the SSP, and/or detecting one or more properties of a portion of the wellbore tubular to which the SSP is operatively attached. As an example, the detecting may include detecting a casing collar, such as via and/or utilizing a casing collar locator. As another example, and as discussed, the SSP may include a magnetic material and/or a radioactive material, and the detecting may include detecting the magnetic material and/or the radioactive material.

As discussed herein with reference to FIG. 1, SSPs 100 according to the present disclosure may include a built-in shockwave generation structure 180. Under these conditions, methods 400 may be performed without performing the positioning at 410.

Figure 7:
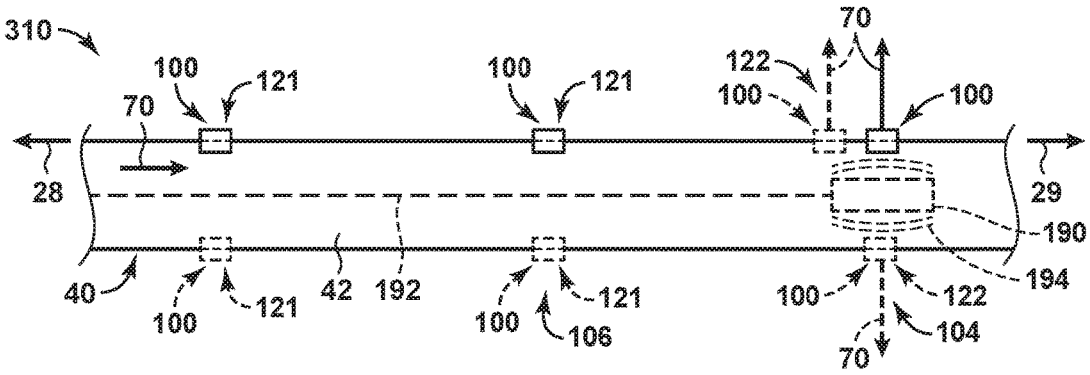
FIG. 7 is a schematic representation of a portion of a process flow for stimulating a subterranean formation utilizing the wellbore tubulars and/or methods according to the present disclosure.

Generating the shockwave at 415 may include generating the shockwave within a wellbore fluid that extends within the tubular conduit. In addition, the generating at 415 may include generating within a region of the tubular conduit that is proximal the selected fraction of the plurality of SSPs such that a magnitude of the shockwave, as received and/or experienced by the selected fraction of the plurality of SSPs, is greater than a threshold shockwave intensity that is sufficient to transition the isolation device of each SSP from the closed state to the open state (i.e., such that the selected fraction of the plurality of SSPs receives and/or experiences the threshold shockwave). This is illustrated in FIG. 7 by the generation of a (threshold) shockwave 194 with shockwave generation device 190, which transitions selected fraction 104 from closed state 121 of FIG. 6 to open state 122 of FIG. 2.

The generating at 415 may be accomplished in any suitable manner. As an example, the generating at 415 may include detonating an explosive charge within the tubular conduit. The explosive charge may be associated with and/or may form a portion of the shockwave generation device, which is separate from the selected fraction of the plurality of SSPs, and/or may be associated with and/or may form a portion of the shockwave generation structure, which forms a portion of one or more of the selected fraction of the plurality of SSPs. As another example, the generating at 415 may include actuating a triggering device, such as a blast cap. The actuating may include remotely actuating and/or wirelessly actuating the triggering device.

When the generating at 415 includes generating with the shockwave generation device, the shockwave generation device may be located within the tubular conduit such that the shockwave has greater than the threshold shockwave intensity within the wellbore fluid that extends within the tubular conduit and in contact with the isolation device of each of the selected fraction of the plurality of SSPs. In addition, the shockwave may have less, may have decayed to less, and/or may have been attenuated to less than the threshold shockwave intensity at a distance that is greater than a maximum effective distance from the shockwave generation device, examples of which are disclosed herein. Thus, a magnitude of the shockwave experienced by a remainder of the plurality of SSPs may be insufficient to to transition an isolation device of any of the remainder of the plurality of SSPs from the closed state to the open state. Stated another way, the shockwave may transition the selected fraction of the plurality of SSPs from the closed state to the open state but may not transition the remainder of the plurality of SSPs from the closed state to the open state. Thus, the generating at 415 may include generating while maintaining fluid connectivity within the tubular conduit and among the plurality of SSPs.

It is within the scope of the present disclosure that the generating at 415 may include generating such that the shockwave emanates at least substantially symmetrically from the shockwave generation device and/or such that the shockwave emanates at least substantially isotropically from the shockwave generation device. Additionally or alternatively, the generating at 415 may include generating such that the shockwave is symmetrical, or at least substantially symmetrical, within a given transverse cross-section of the tubular conduit and/or such that the shockwave has a constant, or at least substantially constant, magnitude within the given transverse cross-section of the tubular conduit at a given point in time.

The shockwave may have any suitable maximum shockwave pressure and/or maximum shockwave duration that is sufficient to transition the isolation device from the closed state to the open state but insufficient to cause damage to the wellbore tubular. Examples of the maximum shockwave pressure and/or of the maximum shockwave duration are disclosed herein.

Propagating the shockwave at 420 may include propagating in any suitable manner. As examples, the propagating at 420 may include propagating the shockwave from the shockwave generation device, propagating the shockwave to the selected fraction of the plurality of SSPs, propagating the shockwave to the isolation device of each of the selected fraction of the plurality of SSPs, and/or propagating the shockwave in and/or within the wellbore fluid.

Attenuating the shockwave at 425 may include attenuating the shockwave in any suitable manner. As examples, the attenuating at 425 may include attenuating by and/or within the wellbore fluid. This may include dissipating at least a portion of the shockwave within the wellbore fluid and/or absorbing energy from the shockwave with the wellbore fluid. The attenuating at 425 may include attenuating at any suitable attenuation rate, examples of which are disclosed herein.

Transitioning the selected isolation device at 430 may include transitioning the isolation device of each of the selected fraction of the plurality of SSPs from the closed state to the open state and/or transitioning to permit fluid communication between the tubular conduit and the subterranean formation via the SSP conduit of each of the selected fraction of the plurality of SSPs. The transitioning at 430 may be at least partially responsive to the generating at 415. As an example, the transitioning may be initiated and/or triggered by receipt of the threshold shockwave with and/or by the selected isolation device of each of the selected fraction of the plurality of SSPs.

The transitioning at 430 may be accomplished in any suitable manner. As an example, the transitioning at 430 may include shattering a frangible disk that defines at least a portion of the isolation device. As another example, the transitioning at 430 may include displacing an isolation disk, which defines at least a portion of the isolation device, from the SSP conduit. The displacing may include shearing a pin that retains the isolation disk within the SSP conduit and/or defeating a clip that retains the isolation device within the SSP conduit.

As discussed, the shockwave may be insufficient, or may have insufficient intensity, to transition the isolation device of the remainder of the plurality of SSPs from the closed state to the open state. As such, the transitioning at 430 may include transitioning the isolation device of each of the selected fraction of the plurality of SSPs without transitioning the remaining isolation devices of the remainder of the plurality of SSPs.

The selected fraction of the plurality of SSPs may include and/or be any suitable number of SSPs. As an example, the selected fraction of the plurality of SSPs may include a single SSP. As another example, the selected fraction of the plurality of SSPs may include at least 2 radially spaced SSPs that are radially spaced apart around a transverse cross-section of the wellbore tubular.

As yet another example, the selected fraction of the plurality of SSPs may include at least 2, or a plurality of, longitudinally spaced SSPs that are longitudinally spaced apart along a length of the wellbore tubular. Under these conditions, the plurality of longitudinally spaced SSPs may extend across a majority, or even all, of a length of a portion of the wellbore tubular that extends within the subterranean formation; and the generating at 415 may include generating within the majority of the length of the portion of the wellbore tubular that extends within the subterranean formation.

As another example, the selected fraction of the plurality of SSPs may include the at least 2 radially spaced SSPs and the at least 2 longitudinally spaced SSPs, as illustrated in dashed lines in FIG. 7. As yet another example, the selected fraction of the plurality of SSPs may include a majority of the plurality of SSPs, all SSPs in the plurality of SSPs, and/or each SSP in the plurality of SSPs.

The at least 2 longitudinally spaced SSPs may include a first SSP, which includes a first SSP conduit, and a second SSP, which includes a second SSP conduit. The first SSP may be positioned uphole from the second SSP, and a minimum SSP cross-sectional area of the first SSP conduit and a minimum SSP conduit cross-sectional area of the second SSP conduit may be selected to maintain equal, or at least substantially equal, flow rates of the stimulant fluid therethrough. As an example, the minimum SSP conduit cross-sectional area of the first SSP conduit may be less than the minimum SSP conduit cross-sectional area of the second SSP conduit.

Flowing the stimulant fluid at 435 may include flowing subsequent to the transitioning at 430 and/or responsive to the transitioning at 430. In addition, the flowing at 435 may include flowing to permit and/or facilitate the stimulating at 440.

As an example, and when methods 400 include the changing at 405 and the changing at 405 includes pressurizing the tubular conduit, the stimulation pressure within the tubular conduit may provide a motive force for the flowing at 435, and the transitioning at 430 may provide a fluid pathway for flow of the stimulant fluid. This is illustrated in FIG. 7, with selected fraction 104 of the plurality of SSPs 100 in open state 122 and stimulant fluid 70 flowing from wellbore tubular 42 and/or into the subterranean formation via selected fraction 104.

As discussed herein, SSPs 100 may include a nozzle, such as nozzle 160 of FIG. 2. Under these conditions, the flowing at 435 further may include accelerating the stimulant fluid with the nozzle.

Stimulating the subterranean formation at 440 may include stimulating the subterranean formation via the SSP conduit. As an example, and as discussed herein with reference to the flowing at 435, the stimulant fluid may flow from the tubular conduit into the subterranean formation via the SSP conduit of each of the selected fraction of the plurality of SSPs.

The stimulating at 440 may include stimulating in any suitable manner. As examples, the stimulating at 440 may include fracturing the subterranean formation, propping the subterranean formation, flushing the subterranean formation, acid-treating the subterranean formation, and/or increasing a surface area of the subterranean formation.

Figure 8:
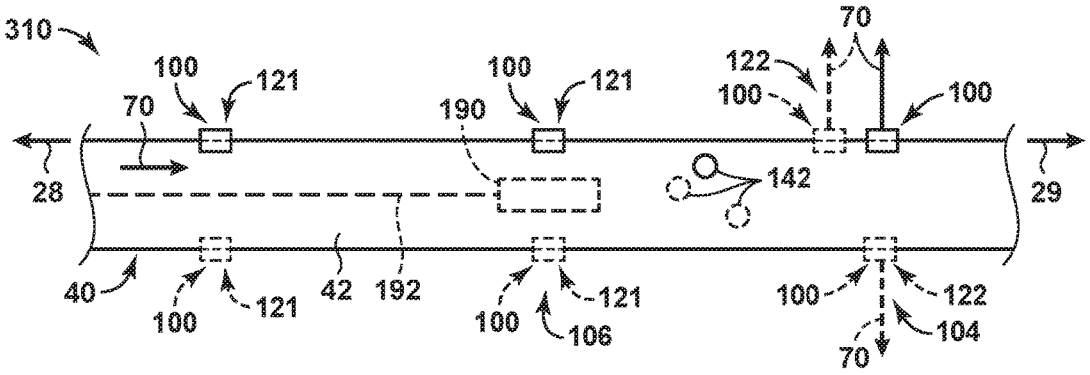
FIG. 8 is a schematic representation of a portion of a process flow for stimulating a subterranean formation utilizing the wellbore tubulars and/or methods according to the present disclosure.
Figure 9:
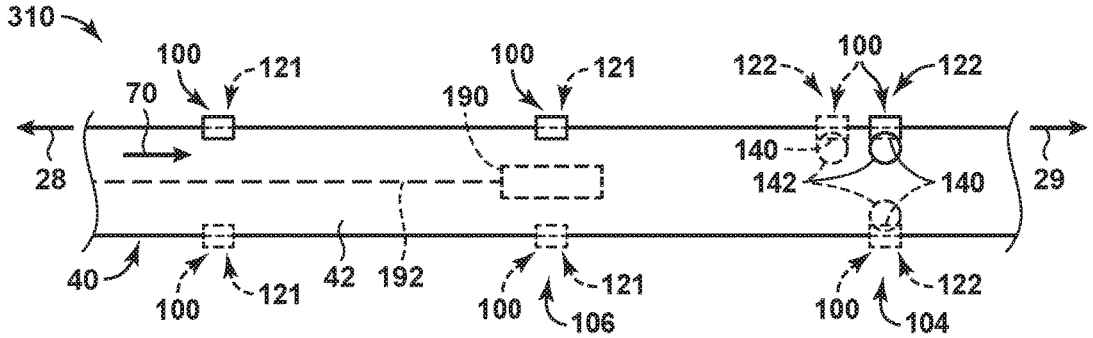
FIG. 9 is a schematic representation of a portion of a process flow for stimulating a subterranean formation utilizing the wellbore tubulars and/or methods according to the present disclosure.

Flowing the sealing device at 445 may include flowing any suitable respective sealing device via and/or along the tubular conduit and into contact and/or engagement with a respective sealing device seat of each of the selected fraction of the plurality of SSPs. This may include flowing to form a fluid seal between the respective sealing device and the respective sealing device seat and/or flowing to selectively restrict fluid flow from the tubular conduit and into the subterranean formation via a respective SSP conduit of each of the selected fraction of the plurality of SSPs. This is illustrated in FIGS. 8-9. In FIG. 8, sealing devices 142 are illustrated as flowing in downhole direction 29 within stimulant fluid 70. In FIG. 9, sealing devices 142 are illustrated as contacting and/or engaging sealing device seats 140 of selected fraction 104 of the plurality of SSPs 100. The flowing at 445 may include flowing within and/or via the stimulant fluid and/or may be performed subsequent to performing the flowing at 435 for at least a threshold stimulation time.

Moving the shockwave generation device at 450 may include moving the shockwave generation device within the tubular conduit. As an example, and as illustrated in FIGS. 7-10, selected fraction 104 may be a first selected fraction 104 of the plurality of SSPs, and the moving at 450 may include moving such that shockwave generation device 190 is proximal a second selected fraction 106 of the plurality of SSPs. This may include moving shockwave generation device 190 in uphole direction 28, such as via umbilical 192.

Repeating at least the portion of the methods at 455 may include repeating any suitable portion of methods 400 in any suitable manner. As an example, the repeating at 455 may include repeating at least the changing at 405, the generating at 415, the transitioning at 430, the flowing at 435, and/or the flowing at 445, while the shockwave generation device is proximal the second selected fraction of the plurality of SSPs (i.e., subsequent to the moving at 450) to stimulate a portion of the subterranean formation that is proximal the second selected fraction of the plurality of SSPs.

Figure 10:
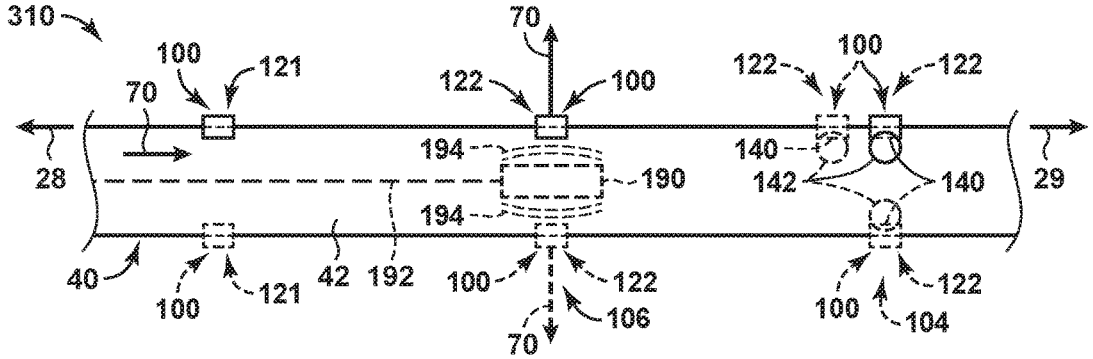
FIG. 10 is a schematic representation of a portion of a process flow for stimulating a subterranean formation utilizing the wellbore tubulars and/or methods according to the present disclosure.

When methods 400 include repeating the changing at 405, the changing may be repeated responsive to, at least partially responsive to, and/or as a result of, the flowing at 445. Additionally or alternatively, and when methods 400 include the repeating at 455, methods 400 further may include retaining the shockwave generation device within the tubular conduit during the repeating at 455 and/or utilizing the shockwave generation device during at least a portion of the repeating at 455. This is illustrated in FIG. 10. Therein, shockwave generation device 190 is proximal second selected fraction 106 of the plurality of SSPs and has generated shockwave 194 to transition second selected fraction 106 to open state 122.

The repeating at 455 may be performed any suitable number of times, such as to stimulate any suitable number of regions and/or zones of the subterranean formation and/or to transition any suitable number of selected fractions of the plurality of SSPs from the closed state to the open state. The repeating at 455 may include sequentially stimulating portions of the subterranean formation that are proximal to each of the plurality of SSPs. Additionally or alternatively, the repeating at 455 also may include maintaining at least one intermediate SSP of the plurality of SSPs in the closed state. The intermediate SSP may be present between an uphole SSP, which may form a portion of second selected fraction 106, and a downhole SSP, which may form a portion of first selected fraction 104. Stated another way, the intermediate SSP may be maintained in the closed state subsequent to the uphole SSP and the downhole SSP being transitioned to respective open states.

Stated yet another way, a third selected fraction of the plurality of SSPs may extend between the first selected fraction of the plurality of SSPs and the second selected fraction of the plurality of SSPs, and the repeating at 455 may include repeating without transitioning the third selected fraction of the plurality of SSPs from the closed state to the open state. Under these conditions, methods 400 further may include performing the producing at 460 for at least a threshold production time and subsequently repeating at least the changing at 405, the generating at 415, the transitioning at 430, and the flowing at 435 to stimulate a portion of the subterranean formation that is proximal the third selected fraction of the plurality of SSPs.

Producing the reservoir fluid at 460 may include producing the reservoir fluid in any suitable manner. As examples, the producing at 460 may include flowing the reservoir fluid from the subterranean formation and into the tubular conduit via the plurality of SSPs and/or flowing the reservoir fluid to the surface region via the tubular conduit.

Figure 11:
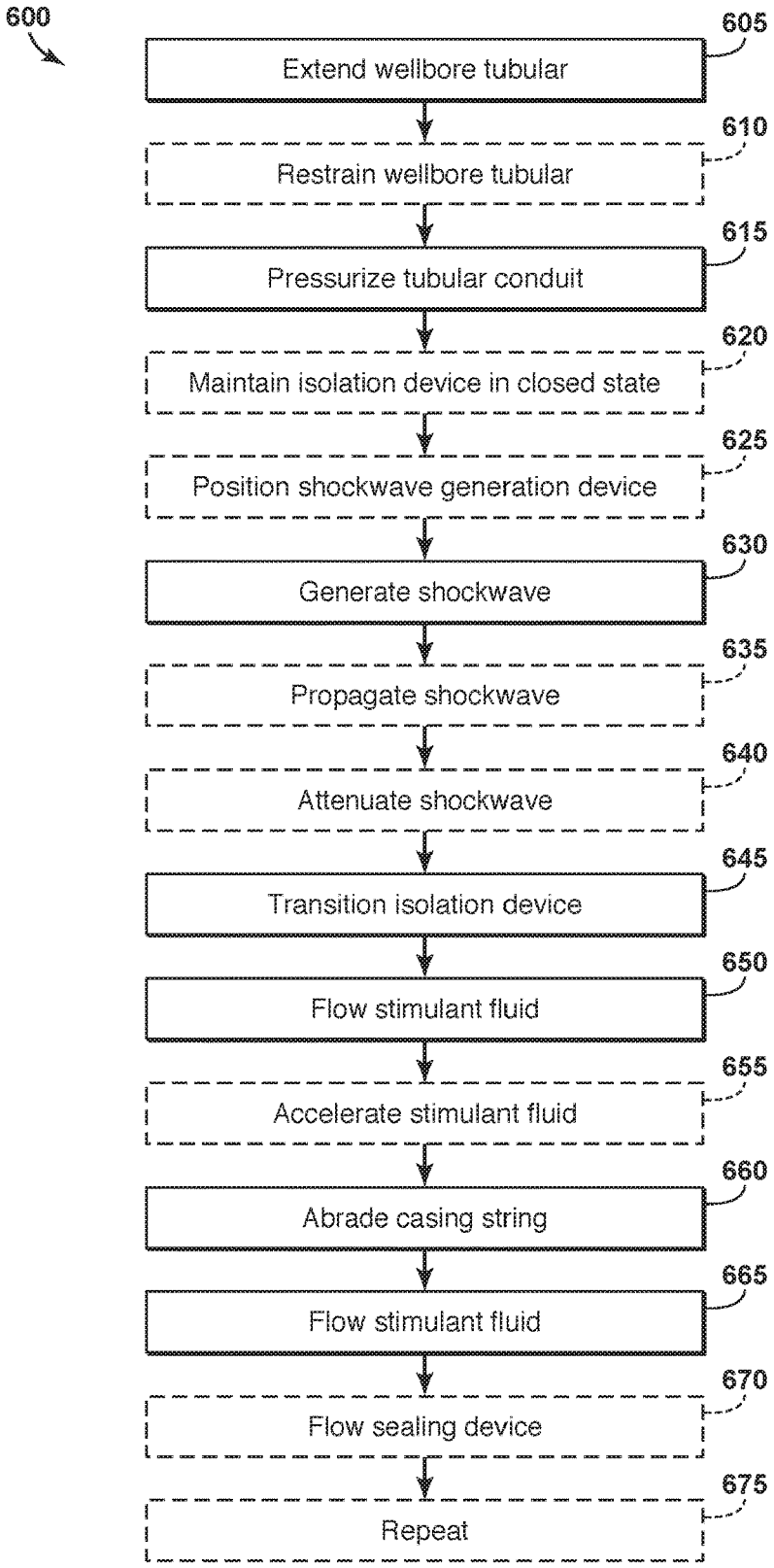
FIG. 11 is a flowchart depicting methods, according to the present disclosure, of re-stimulating a subterranean formation.

FIG. 11 is a flowchart depicting methods 600, according to the present disclosure, of re-stimulating a subterranean formation. FIGS. 12-16 are schematic representations of portions of a process flow 320 for re-stimulating a subterranean formation, such as via utilizing wellbore tubulars 40 and/or methods 600 according to the present disclosure. As illustrated in process flow 320 of FIGS. 12-16, a wellbore tubular 40, which may define a tubular conduit 42, may include a plurality of selective stimulation ports (SSPs) 100. The wellbore tubular of FIGS. 12-16 may include any of the structures, functions, and/or features of wellbore tubular 40 of any of FIGS. 1-4.

As illustrated in FIG. 11, methods 600 include extending a wellbore tubular at 605 and may include restraining the wellbore tubular at 610. Methods 600 further include pressurizing a tubular conduit of the wellbore tubular at 615 and may include maintaining an isolation device in a closed state at 620 and/or positioning a shockwave generation device at 625. Methods 600 also include generating a shockwave at 630 and may include propagating the shockwave at 635 and/or attenuating the shockwave at 640. Methods 600 further include transitioning an isolation device at 645 and flowing a stimulant fluid at 650 and may include accelerating the stimulant fluid at 655. Methods 600 also include abrading a casing string at 660 and flowing the stimulant fluid at 665, and methods 600 may include flowing a sealing device at 670 and/or repeating at least a portion of the methods at 675.

Figure 12:
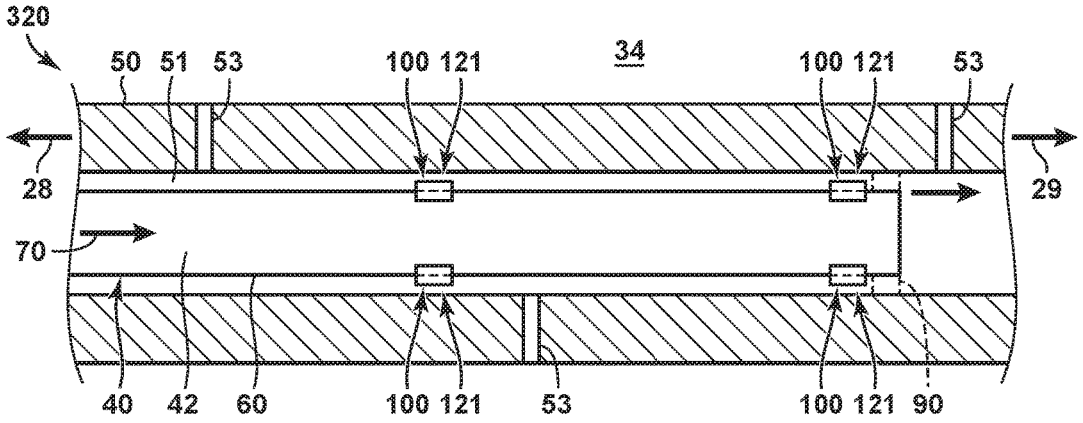
FIG. 12 is a schematic representation of a portion of a process flow for re-stimulating a subterranean formation utilizing the wellbore tubulars and/or methods according to the present disclosure.

Extending the wellbore tubular at 605 may include extending the wellbore tubular into and/or within a casing conduit. The casing conduit may be defined by a casing string of a hydrocarbon well that extends within a subterranean formation. This is illustrated in FIG. 12. Therein, a wellbore tubular 40 that defines a tubular conduit 42 is illustrated as extending, or being extended, located, and/or placed, within a casing conduit 51 of a casing string 50 that extends within a subterranean formation 34. As discussed, in such a configuration, wellbore tubular 40 may be described as an inter-casing tubular 60. The wellbore tubular includes a plurality of selective stimulation ports (SSPs) 100. The casing string includes a plurality of existing perforations 53 that are present within the casing string prior to performing methods 600 and/or that include a plurality of shape charge-generated perforations.

The extending at 605 may be accomplished in any suitable manner. As examples, the extending at 605 may include progressively increasing a length of the wellbore tubular that extends within the casing conduit, translating a longitudinal axis of the wellbore tubular along a longitudinal axis of the casing conduit, and/or translating a terminal end of the wellbore tubular within the casing conduit and in a downhole direction.

Figure 13:
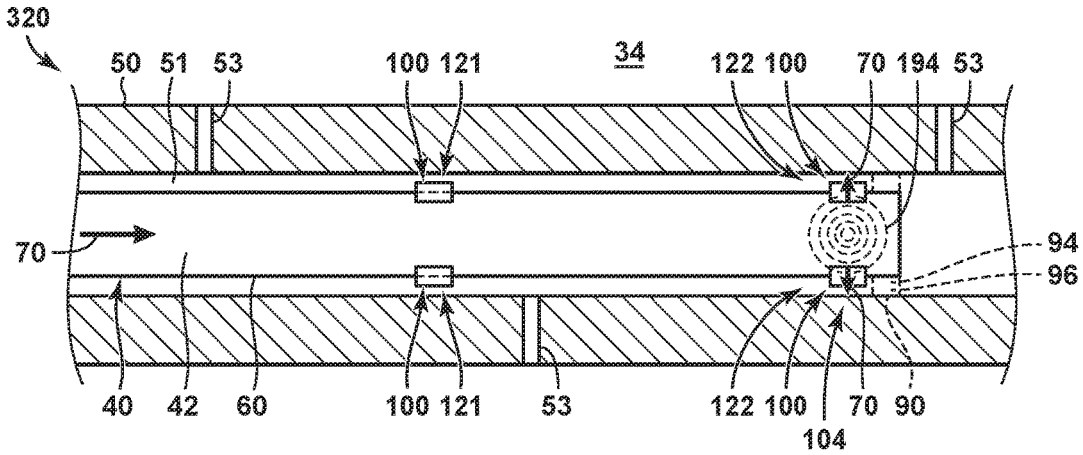
FIG. 13 is a schematic representation of a portion of a process flow for re-stimulating a subterranean formation utilizing the wellbore tubulars and/or methods according to the present disclosure.

Restraining the wellbore tubular at 610 may include restraining the wellbore tubular within the casing conduit in any suitable manner. As an example, the restraining at 610 may include mechanically coupling at least a portion of the wellbore tubular to at least a portion of the casing string. As more specific examples, the mechanically coupling may include mechanically coupling with and/or utilizing a liner hanger 94 and/or a packer 96, as illustrated in FIG. 13.

Pressurizing the tubular conduit at 615 may include pressurizing the tubular conduit with a stimulant fluid that includes an abrasive material. The pressurizing at 615 may be similar, or at least substantially similar, to the changing the pressure at 405, which is discussed herein with reference to methods 400 of FIG. 5.

Maintaining the isolation device in the closed state at 620 may include maintaining a respective isolation device of each of the plurality of SSPs in the closed state during the pressurizing at 615, despite the pressurizing at 615, and/or prior to the generating at 630. As examples, the maintaining at 620 may include resisting fluid flow through a respective SSP conduit of each of the plurality of SSPs with the respective isolation device.

Positioning the shockwave generation device at 625 may include positioning the shockwave generation device, which may be separate and/or spaced apart from the plurality of SSPs, within the tubular conduit and near and/or proximal a selected fraction of the plurality of SSPs. The positioning at 625 may be accomplished in any suitable manner, including those that are discussed herein with reference to the positioning at 410 of methods 400 of FIG. 5.

Generating the shockwave at 630 may include generating the shockwave within the tubular conduit, generating the shockwave with the shockwave generation device, generating the shockwave with a shockwave generation structure that forms a portion of one or more of the selected fraction of the plurality of SSPs, and/or generating the shockwave near and/or proximal the selected fraction of the plurality of SSPs. This is illustrated in FIG. 13, with shockwave 194 being generated proximal a selected fraction 104 of the plurality of SSPs 100 to transition the selected fraction to open state 122. The generating at 630 may be accomplished in any suitable manner, including those that are disclosed herein with reference to the generating at 415 of methods 400 of FIG. 5.

Propagating the shockwave at 635 may include propagating the shockwave from the shockwave generation device, to the selected fraction of the plurality of SSPs, and/or within the wellbore fluid. The propagating at 635 may be at least substantially similar to the propagating at 420, which is discussed herein with reference to methods 400 of FIG. 5.

Attenuating the shockwave at 640 may include attenuating the shockwave with and/or within the wellbore fluid. The attenuating at 640 may be at least substantially similar to the attenuating at 425, which is discussed herein with reference to methods 400 of FIG. 5.

Transitioning the isolation device at 645 may include transitioning each isolation device of the selected fraction of the plurality of SSPs from a respective closed state to a respective open state and may be responsive to the generating at 630. The transitioning at 645 may be at least substantially similar to the transitioning at 430, which is discussed herein with reference to methods 400 of FIG. 5.

Flowing the stimulant fluid at 650 may be responsive to the transitioning at 645. The flowing at 650 may include flowing the stimulant fluid through a selected SSP conduit of each of the selected fraction of the plurality of SSPs, flowing the stimulant fluid from the tubular conduit and into an annular space that extends between the wellbore tubular and the casing string, and/or flowing the stimulant fluid such that the stimulant fluid impinges upon an inner casing surface of the casing string.

Figure 14:
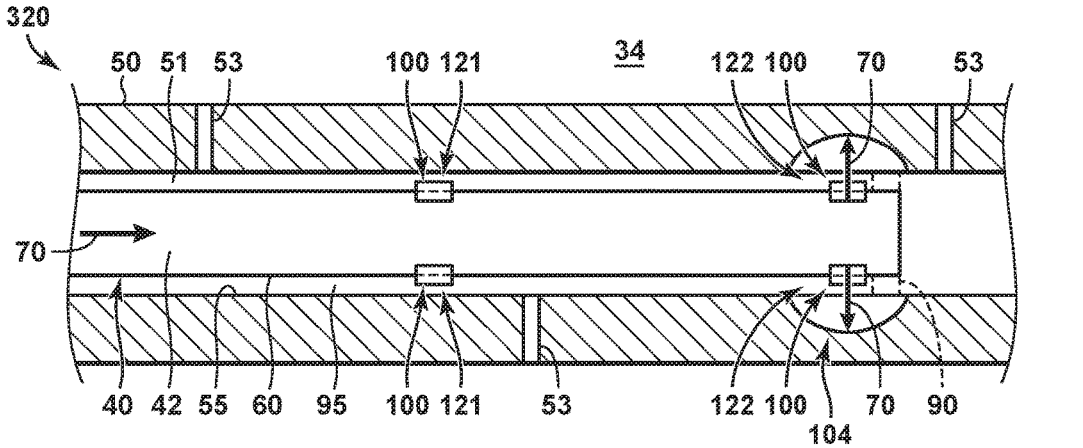
FIG. 14 is a schematic representation of a portion of a process flow for re-stimulating a subterranean formation utilizing the wellbore tubulars and/or methods according to the present disclosure.

This is illustrated in FIG. 14. Therein, stimulant fluid 70 flows from selected fraction 104 of the plurality of SSPs 100, into an annular space 95, and impinges upon and/or impacts an inner casing surface 55 of casing string 50. As illustrated, flow of the stimulant fluid through the selected SSP conduit of each of the selected fraction of the plurality of SSPs may include flowing in a direction that is perpendicular, or at least substantially perpendicular, to the inner casing surface.

Accelerating the stimulant fluid at 655 may include accelerating the stimulant fluid with, via, and/or utilizing a nozzle. As an example, the accelerating at 655 may include flowing the stimulant fluid through the nozzle, and the accelerating at 655 may be utilized to facilitate and/or to increase an efficiency of the abrading at 660. Examples of the nozzle are disclosed herein with reference to nozzle 160 of FIG. 2.

Figure 15:
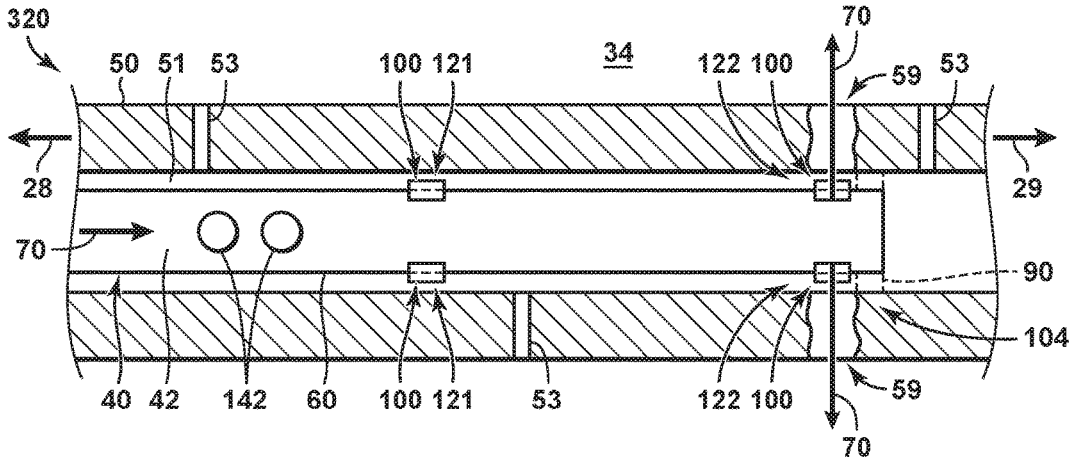
FIG. 15 is a schematic representation of a portion of a process flow for re-stimulating a subterranean formation utilizing the wellbore tubulars and/or methods according to the present disclosure.

Abrading the casing string at 660 may include abrading the casing string with the abrasive material of, or conveyed within, the stimulant fluid. Stated another way, the abrading at 660 may include abrading responsive to, or as a result of, the flowing at 650 and/or the accelerating at 655, such as via impinging the abrasive material onto the casing string and/or onto the inner casing surface. The abrading at 660 may include abrading to form, create, and/or establish a hole in and/or within the casing string, and a respective hole may be formed via flow of the stimulant fluid through the SSP conduit of each of the selected fraction of the plurality of SSPs. This is illustrated in FIG. 15, where a hole 59 is associated with SSPs 100 that are in open state 122 and/or that have stimulant fluid 70 flowing therethrough.

Flowing the stimulant fluid at 665 may include flowing the stimulant fluid from the tubular conduit, through each SSP that is in open state 122, through and/or via the hole that is associated with each SSP that is in the open state, and/or into the subterranean formation. The flowing at 665 may include flowing to stimulate the subterranean formation. This may include fracturing the subterranean formation, propping the subterranean formation, flushing the subterranean formation, acid-treating the subterranean formation, and/or increasing a surface area, a surface contact area, and/or a porosity of the subterranean formation.

Figure 16:
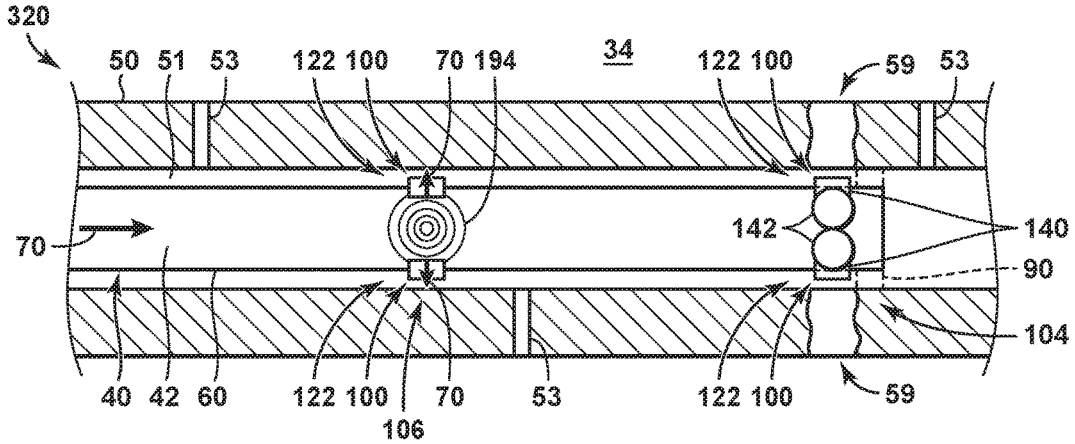
FIG. 16 is a schematic representation of a portion of a process flow for re-stimulating a subterranean formation utilizing the wellbore tubulars and/or methods according to the present disclosure.

Flowing the sealing device at 670 may include flowing a respective sealing device into contact with a respective sealing device seat of each of the selected fraction of the plurality of SSPs and/or forming a fluid seal between the respective sealing device and the respective sealing device seat. Formation of the fluid seal may selectively restrict fluid flow from the tubular conduit, via the selected SSP conduit of each of the selected fraction of the plurality of SSPs, and/or into the subterranean formation. This is illustrated in FIGS. 15-16. In FIG. 15, sealing devices 142 are flowing in a downhole direction 29. In FIG. 16, the sealing devices are contacting and/or engaged with sealing device seats 140 of selected fraction 104 of the plurality of SSPs 100 and restrict fluid flow from tubular conduit 42 via the selected fraction of the plurality of SSPs.

Repeating at least the portion of the methods at 675 may include repeating any suitable portion of methods 600. As an example, selected fraction 104 may be a first selected fraction 104 of the plurality of SSPs 100, and wellbore tubular 40 also may include a second selected fraction 106 of the plurality of SSPs 100. Under these conditions, and subsequent to the flowing at 670 and/or to receipt of the respective sealing devices on the respective sealing device seats, the repeating at 675 may include repeating at least the generating at 630, the transitioning at 645, the flowing at 650, the abrading at 660, and the flowing at 665 to stimulate another region of the subterranean formation via and/or utilizing second selected fraction 106 of the plurality of SSPs 100. This is illustrated in FIG. 16, wherein a shockwave 194 is generated proximal second selected fraction 106 of the plurality of SSPs 100 to transition the second selection fraction of the plurality of SSPs to open state 122.

Figure 17:
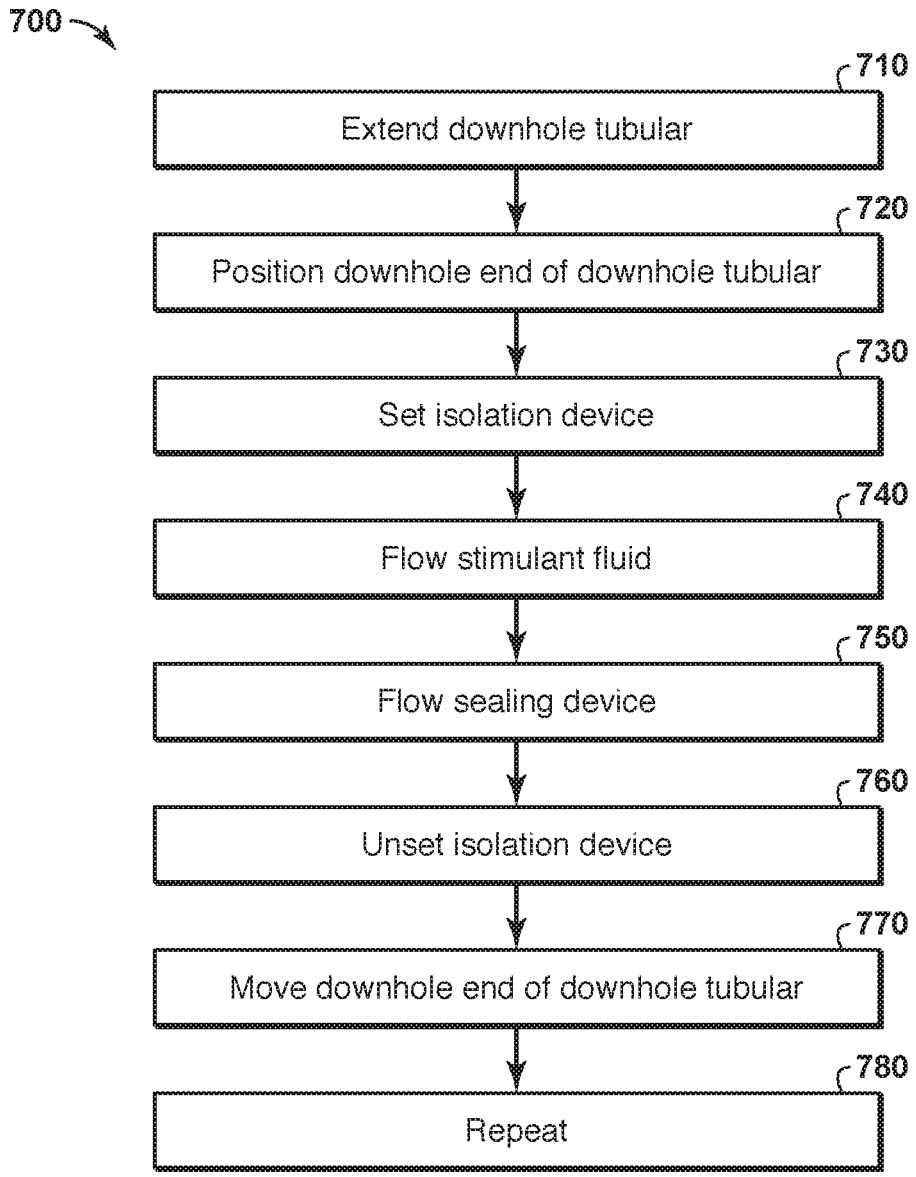
FIG. 17 is a flowchart depicting methods, according to the present disclosure, of re-stimulating a subterranean formation.
Figure 18:
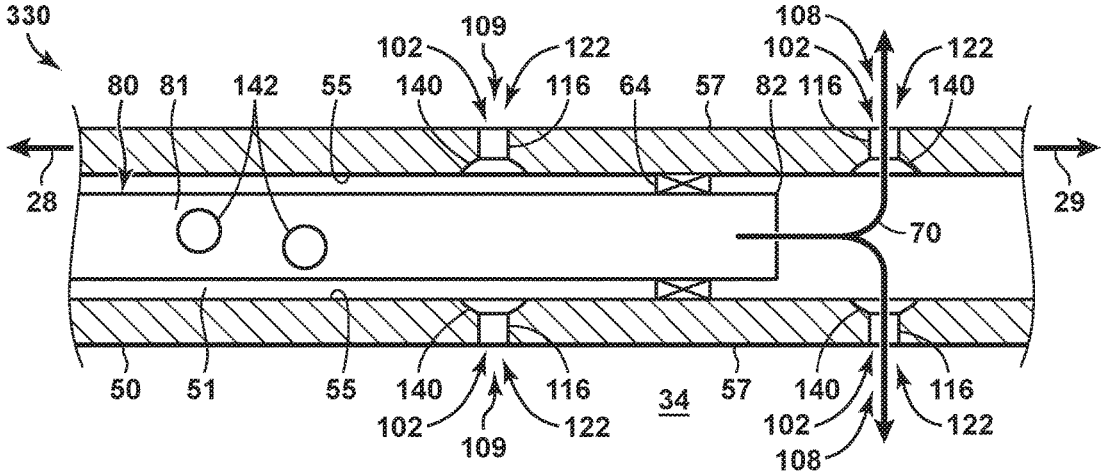
FIG. 18 is a schematic representation of a portion of a process flow for re-stimulating a subterranean formation utilizing the wellbore tubulars and/or methods according to the present disclosure.
Figure 19:
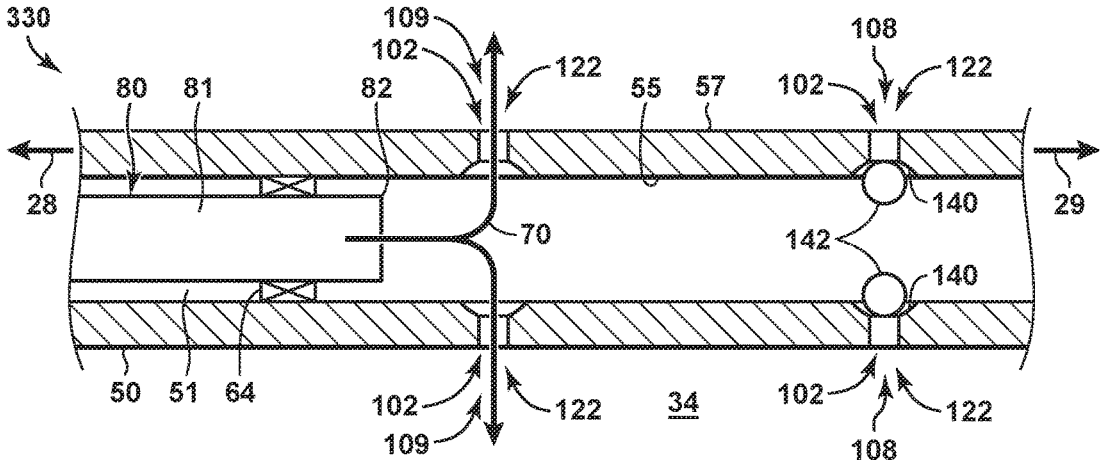
FIG. 19 is a schematic representation of a portion of a process flow for re-stimulating a subterranean formation utilizing the wellbore tubulars and/or methods according to the present disclosure.

FIG. 17 is a flowchart depicting methods 700, according to the present disclosure, of re-stimulating a subterranean formation. FIGS. 18-19 are schematic representations of steps in a process flow 330 for re-stimulating a subterranean formation utilizing wellbore tubulars 40 and/or methods 700 according to the present disclosure. As illustrated in process flow 330 of FIGS. 18-19, a downhole tubular 80 may define a downhole tubular conduit 81 and may extend within a casing conduit 51 of a casing string 50. The casing string may extend within a subterranean formation 34 and may include an inner casing surface 55 and an outer casing surface 57. The casing string also may include a plurality of previously actuated selective stimulation ports (PASSPs) 102 that already may be in open state 122.

Each of the plurality of PASSPs 102 may include an SSP conduit 116 and a sealing device seat 140. PASSPs 102 may be at least substantially similar to SSPs 100 of FIGS. 1-4; however, PASSPs 102 may not include isolation device 120 and/or already may have had the isolation device removed therefrom, such as via transitioning to open state 122.

Methods 700 include extending the downhole tubular at 710, positioning a downhole end of the downhole tubular at 720, setting an isolation device at 730, flowing a stimulant fluid at 740, and flowing a sealing device at 750. Methods 700 further include unsetting the isolation device at 760, moving the downhole end of the downhole tubular at 770, and repeating at least a portion of the methods at 780.

Extending the downhole tubular at 710 may include extending the downhole tubular within the casing conduit of the casing string. This may include progressively increasing a length of the downhole tubular that extends within the casing conduit, translating a longitudinal axis of the downhole tubular along a longitudinal axis of the casing conduit, and/or translating the downhole end of the downhole tubular within the casing conduit and in a downhole direction. The extending at 710 may be at least substantially similar to the extending at 605, which is discussed herein with reference to methods 600 of FIG. 11.

Positioning the downhole end of the downhole tubular at 720 may include positioning proximate a selected one of the plurality of PASSPs. This may include positioning such that the downhole end of the downhole tubular is uphole from the selected one of the plurality of PASSPs and/or such that the isolation device is uphole from the selected one of the plurality of PASSPs. This is illustrated in FIG. 18. Therein, a downhole end 82 of downhole tubular 80 and an isolation device 64 both are uphole from a selected one 108 of the plurality of PASSPs 102.

Setting the isolation device at 730 may include setting to fluidly isolate the selected one of the plurality of PASSPs from at least a portion of a remainder of the plurality of PASSPs and/or to restrict motion of the downhole tubular within and/or relative to the casing conduit. As an example, the setting at 730 may include setting to fluidly isolate, or fluidly isolating, the selected one of the plurality of PASSPs from one or more other PASSPs that are uphole from the downhole end of the downhole tubular and/or that are uphole from the isolation device.

The setting at 730 may include forming a fluid seal between the downhole tubular and an inner casing surface of the casing string, forming a fluid seal between the isolation device and the inner casing surface, and/or forming a fluid seal between the isolation device and the downhole tubular. As such, the setting the isolation device may include restricting, blocking, and/or occluding fluid flow and/or communication between the downhole end of the downhole tubular and a portion of the plurality of PASSPs that is uphole from the selected one of the plurality of PASSPs. This is illustrated in FIG. 18. Therein, isolation device 64 fluidly isolates selected one 108 of the plurality of PASSPs from one or more uphole PASSPs 109 of the plurality of PASSPs.

Flowing the stimulant fluid at 740 may include flowing through and/or via the downhole tubular conduit and/or through the SSP conduit of the selected one of the plurality of PASSPs. Additionally or alternatively, the flowing at 740 may include flowing to re-stimulate, or re-stimulating, a portion of the subterranean formation that is proximal the selected one of the plurality of PASSPs. The flowing at 740 additionally or alternatively may include flowing the stimulant fluid from a surface region and/or via the downhole tubular conduit, flowing the stimulant fluid from the downhole tubular conduit and/or into the casing conduit, and/or flowing the stimulant fluid from the casing conduit and/or via the SSP conduit and into the subterranean formation. This is illustrated in FIG. 18. Therein, stimulant fluid 70 flows into subterranean formation 34 via downhole tubular conduit 81, casing conduit 51, and/or SSP conduit 116 to re-stimulate the subterranean formation.

Flowing the sealing device at 750 may include flowing the sealing device through and/or via the downhole tubular conduit, flowing the sealing device into engagement with the sealing device seat of the selected one of the plurality of PASSPs, conveying the sealing device within the stimulant fluid, and/or forming the fluid seal between the sealing device and the selected one of the plurality of PASSPs. This is illustrated in FIGS. 18-19. In FIG. 18, sealing devices 142 are illustrated as flowing through downhole tubular conduit 81 and within stimulant fluid 70. In FIG. 19, sealing devices 142 are illustrated in engagement with sealing device seats 140 of PASSPs 102 and thereby restrict fluid flow from casing conduit 51 and into subterranean formation 34.

Unsetting the isolation device at 760 may include establishing and/or permitting fluid flow and/or communication between the selected one of the plurality of PASSPs and the portion of the plurality of PASSPs that is uphole from the selected one of the plurality of PASSPs and/or between the downhole end of the downhole tubular and the portion of the plurality of PASSPs that is uphole from the selected one of the plurality of PASSPs. Additionally or alternatively, the unsetting at 760 may include unsetting to permit, or permitting, motion of the downhole tubular within and/or relative to the casing conduit, such as to permit the moving at 770.

Moving the downhole end of the downhole tubular at 770 may include moving in an uphole direction and/or moving such that the downhole end of the downhole tubular is uphole from another, or a different, PASSP of the plurality of PASSPs. This may include moving the downhole end of the downhole tubular past the other, or the different, PASSP. The moving at 770 additionally or alternatively may include progressively decreasing the length of the downhole tubular that extends within the casing conduit, translating the longitudinal axis of the downhole tubular along the longitudinal axis of the casing conduit, translating the downhole end of the downhole tubular within the casing conduit and in an uphole direction, and/or at least partially retracting the downhole tubular from the casing conduit. This is illustrated in FIG. 19. As illustrated therein, downhole end 82 of downhole tubular 80 has been moved in uphole direction 28 such that the downhole end is uphole from at least one uphole PASSP 109 that previously was uphole from the downhole end of the downhole tubular (as illustrated in FIG. 18).

Repeating at least the portion of the methods at 780 may include repeating any suitable portion of methods 700 in any suitable manner and/or in any suitable order. As an example, the repeating at 780 may include repeating the setting at 730 and repeating the flowing at 740 to re-stimulate a portion of the subterranean formation that is proximal the other PASSP and/or that is uphole from the selected one of the plurality of PASSPs. The repeating at 780 further may include repeating the flowing at 750, repeating the unsetting at 760, and repeating the moving at 770, such as to permit re-stimulation of yet another portion of the subterranean formation. As an example, the repeating at 780 may include repeating a plurality of times to re-stimulate a plurality of respective portions of the subterranean formation that are proximal a plurality of respective ones of the plurality of PASSPs.

It is within the scope of the present disclosure that the repeating at 780 may include repeating without removing the downhole end of the downhole tubular from the casing conduit. Additionally or alternatively, the repeating at 780 may include re-stimulating along an entirety of a length of the casing string and/or re-stimulating without fluidly isolating the downhole tubular conduit from a downhole end of the casing string.

As discussed herein, PASSPs 102 may include sealing device seats 140 that may include and/or be erosion-resistant sealing device seats and/or corrosion-resistant sealing device seats. As such, and in contrast with conventional perforations that may be formed within a casing string via conventional perforation devices and/or that may be formed subsequent to the casing string being located within the subterranean formation, PASSPs 102 according to the present disclosure may resist wear and/or corrosion during stimulation of the subterranean formation therethrough. Such resistance to wear and/or corrosion may permit PASSPs 102 according to the present disclosure to form an at least substantially fluid-tight fluid seal with a sealing device even after stimulation of the subterranean formation and/or to production of the reservoir fluid from the subterranean formation.

As an alternative to methods 700 of FIG. 17 and/or process flow 330 of FIGS. 18-19, a stimulant fluid may be pumped into a casing string that includes a plurality of previously actuated SSPs (PASSPs). The stimulant fluid may flow through all, or nearly all, of the plurality of PASSPs; however, a majority of the stimulant fluid may flow through one or more PASSPs that are associated with permeable regions of the subterranean formation. The permeable regions of the subterranean formation may have a higher permeability than restricted regions of the subterranean formation that are associated with other PASSPs. As such, these permeable regions may be re-stimulated while the restricted regions may not be re-stimulated. Additionally or alternatively, the permeable regions may receive a majority of the stimulant fluid flow.

Subsequently, one or more sealing devices may be placed within a casing conduit of the casing string and permitted to flow, with the stimulant fluid, through the casing conduit. These sealing devices preferentially may form a fluid seal with the PASSPs that are associated with the permeable regions of the subterranean formation, as there will be the largest flow of the stimulant fluid through these PASSPs. Formation of the fluid seal with these PASSPs may increase a pressure within the casing conduit, thereby causing the flow rate of the stimulant fluid to increase through one or more other PASSPs and increasing stimulation of one or more restricted regions of the subterranean formation that may be associated with the one or more other PASSPs.

By maintaining the flow of stimulant fluid and repeatedly releasing the sealing devices into the casing conduit, a substantial fraction, a majority, or even all of the PASSPs may be utilized to re-stimulate the subterranean formation. Once again, the erosion and/or corrosion-resistant nature of sealing device seats associated with PASSPs according to the present disclosure may permit and/or facilitate such a method due to the fluid-tight seal that may be formed between the sealing device seats and the sealing devices.

In the present disclosure, several of the illustrative, non-exclusive examples have been discussed and/or presented in the context of flow diagrams, process flows, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems, wellbore tubulars, and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A wellbore tubular configured to extend within a subterranean formation, the wellbore tubular comprising:

a tubular body including an external surface and an internal surface, wherein the internal surface defines a tubular conduit; and a plurality of selective stimulation ports (SSPs), wherein each SSP of the plurality of SSPs includes:

(i) a SSP conduit extending between the internal surface of the tubular body and the external surface of the tubular body; and (ii) an isolation device configured to selectively transition from a closed state, in which the isolation device restricts fluid flow through the SSP conduit, to an open state, in which the isolation device permits fluid flow through the SSP conduit, responsive to a shockwave, within a wellbore fluid extending within the tubular conduit, that has greater than a threshold shockwave intensity, wherein the isolation device is retained in the closed state prior to receipt of the shockwave, and wherein the isolation device is selectively transitioned from a closed state to an open state by at least one of;

(a) shattering a frangible disk that defines at least a portion of the selected isolation device of each SSP of the selected fraction of the plurality of SSPs; and (b) displacing an isolation disk, which defines at least a portion of the selected isolation device of each SSP of the selected fraction of the plurality of SSPs, from the selected SSP conduit of each SSP of the selected fraction of the plurality of SSPs.

2. The wellbore tubular of claim 1, wherein the plurality of SSPs includes a plurality of longitudinally spaced SSPs that is spaced apart along a longitudinal length of the wellbore tubular.

3. The wellbore tubular of claim 2, wherein the SSP conduit of each SSP of the plurality of longitudinally spaced SSPs has a minimum SSP conduit cross-sectional area, and further wherein the minimum SSP conduit cross-sectional area varies systematically with location along the longitudinal length of the wellbore tubular.

4. The wellbore tubular of claim 3, wherein the wellbore tubular includes an uphole tubular end and a downhole tubular end, and further wherein the minimum SSP conduit cross-sectional area of respective SSPs of the plurality of longitudinally spaced SSPs increases systematically from the uphole tubular end toward the downhole tubular end.

5. The wellbore tubular of claim 3, wherein the wellbore tubular includes a plurality of stimulation zones, wherein each stimulation zone of the plurality of stimulation zones includes a respective subset of the plurality of longitudinally spaced SSPs, wherein each stimulation zone of the plurality of stimulation zones includes an uphole zone end and a downhole zone end, and further wherein the minimum SSP conduit cross-sectional area of respective SSPs of the plurality of longitudinally spaced SSPs increases systematically from the uphole zone end toward the downhole zone end.

6. The wellbore tubular of claim 2, wherein the SSP conduit of each SSP of the plurality of longitudinally spaced SSPs has a minimum SSP conduit cross-sectional area, and further wherein the minimum SSP conduit cross-sectional area of each SSP of the plurality of longitudinally spaced SSPs is at least substantially equal to a minimum SSP conduit cross-sectional area of a remainder of the plurality of longitudinally spaced SSPs.

7. The wellbore tubular of claim 1, wherein the plurality of SSPs includes a plurality of radially spaced SSPs that is spaced apart around a transverse cross-section of the wellbore tubular.

8. The wellbore tubular of claim 1, wherein each SSP of the plurality of SSPs further includes a sealing device seat shaped to form a fluid seal with a sealing device that selectively flows into engagement with the sealing device seat to selectively restrict fluid flow from the tubular conduit via the SSP conduit when the sealing device forms the fluid seal therewith.

9. The wellbore tubular of claim 8, wherein the sealing device seat has a preconfigured geometry established prior to the tubular conduit being installed within the subterranean formation.

10. The wellbore tubular of claim 8, wherein a shape of the sealing device seat of each SSP of the plurality of SSPs is at least substantially similar.

11. The wellbore tubular of claim 8, wherein the sealing device seat is an erosion-resistant sealing device seat configured to resist erosion by particulate material, which is present within the wellbore fluid, during flow of the wellbore fluid through the sealing device seat.

12. The wellbore tubular of claim 8, wherein the sealing device seat is a corrosion-resistant sealing device seat configured to resist corrosion by the wellbore fluid during fluid contact between the sealing device seat and the wellbore fluid.

13. A hydrocarbon well, comprising:

a wellbore extending within a subterranean formation that includes a hydrocarbon fluid; and the wellbore tubular of claim 1, wherein the wellbore tubular extends within the wellbore.

14. A method of stimulating a subterranean formation, the method comprising:

generating a shockwave within a wellbore fluid that extends within a tubular conduit with a shockwave generation device, wherein the tubular conduit is defined by the wellbore tubular of claim 1, wherein the wellbore tubular extends within the subterranean formation, wherein the generating includes generating within a region of the tubular conduit that is proximal a selected fraction of the plurality of SSPs such that a magnitude of the shockwave received by the selected fraction of the plurality of SSPs is greater than a threshold intensity that is sufficient to transition a selected isolation device of each SSP of the selected fraction of the plurality of SSPs from a respective closed state to a respective open state, and further wherein the generating includes generating such that the magnitude of the shockwave experienced by a remainder of the plurality of SSPs is insufficient to transition an isolation device of any SSP of the remainder of the plurality of SSPs from the closed state to the open state; and responsive to receipt of the shockwave, transitioning the selected isolation device of each SSP of the selected fraction of the plurality of SSPs from the respective closed state to the respective open state to permit fluid communication, via a selected SSP conduit of each SSP of the selected fraction of the plurality of SSPs, between the tubular conduit and the subterranean formation, and wherein the isolation device is selectively transitioned from a closed state to an open state by at least one of;

(a) shattering a frangible disk that defines at least a portion of the selected isolation device of each SSP of the selected fraction of the plurality of SSPs; and (b) displacing an isolation disk, which defines at least a portion of the selected isolation device of each SSP of the selected fraction of the plurality of SSPs, from the selected SSP conduit of each SSP of the selected fraction of the plurality of SSPs.

15. The method of claim 14, wherein the selected fraction of the plurality of SSPs includes a single SSP of the plurality of SSPs, and further wherein the transitioning includes transitioning the single SSP without transitioning a remainder of the plurality of SSPs.

16. The method of claim 14, wherein the selected fraction of the plurality of SSPs includes at least 2 radially spaced SSPs that are radially spaced apart around a transverse cross-section of the wellbore tubular, and further wherein the transitioning includes transitioning the at least 2 radially spaced SSPs without transitioning a remainder of the plurality of SSPs.

17. The method of claim 14, wherein the selected fraction of the plurality of SSPs includes a plurality of longitudinally spaced SSPs that are longitudinally spaced apart along a length of the wellbore tubular, wherein the plurality of longitudinally spaced SSPs extends across a majority of a length of a portion of the wellbore tubular that extends within the subterranean formation, and further wherein the generating includes generating within the majority of the length of the portion of the wellbore tubular that extends within the subterranean formation.

18. The method of claim 14, wherein the generating includes detonating an explosive charge within the tubular conduit, wherein the explosive charge defines at least a portion of the shockwave generation device.

19. The method of claim 18, wherein the shockwave generation device is spaced apart from the selected fraction of the plurality of SSPs and present within the tubular conduit, and further wherein, prior to the generating, the method includes positioning the shockwave generation device within the tubular conduit and proximal the selected fraction of the plurality of SSPs.

20. The method of claim 19, wherein the positioning includes detecting a proximity of the shockwave generation device to the selected fraction of the plurality of SSPs.

21. The method of claim 14, wherein the method further includes propagating the shockwave, from the shockwave generation device and to the selected fraction of the plurality of SSPs, within the wellbore fluid.

22. The method of claim 14, wherein the method further includes attenuating the shockwave by the wellbore fluid at an attenuation rate of at least 10 megapascals per meter.

23. The method of claim 14, wherein the generating the shockwave includes generating with a maximum pressure of at least 170 megapascals and a maximum duration of less than 0.1 seconds.

24. The method of claim 14, wherein the generating includes generating such that the shockwave exhibits greater than the threshold intensity within the tubular conduit over a maximum distance of 4 meters along a length of the tubular conduit.

25. The method of claim 14, wherein the generating includes generating while maintaining fluid connectivity within the tubular conduit and among the plurality of SSPs.

26. The method of claim 14, wherein the transitioning includes at least one of:

(i) shattering a frangible disk that defines at least a portion of the selected isolation device of each SSP of the selected fraction of the plurality of SSPs; and (ii) displacing an isolation disk, which defines at least a portion of the selected isolation device of each SSP of the selected fraction of the plurality of SSPs, from the selected SSP conduit of each SSP of the selected fraction of the plurality of SSPs.

27. The method of claim 14, wherein the method further includes stimulating the subterranean formation via the selected SSP conduit of each SSP of the selected fraction of the plurality of SSPs.

28. The method of claim 14, wherein:

(i) prior to the generating, the method further includes pressurizing the tubular conduit to a pressure of at least 30 megapascals with a stimulant fluid, wherein the method includes retaining a respective isolation device of each SSP of the plurality of SSPs in the closed state during the pressurizing;

(ii) responsive to the transitioning, the method further includes flowing the stimulant fluid into the subterranean formation, via the selected SSP conduit of each SSP of the selected fraction of the plurality of SSPs, to stimulate the subterranean formation; and (iii) subsequent to flowing the stimulant fluid for at least a threshold stimulation time, the method further includes flowing a respective sealing device into contact with a respective sealing device seat of each SSP of the selected fraction of the plurality of SSPs to form a fluid seal and to selectively restrict fluid flow from the tubular conduit to the subterranean formation via the selected SSP conduit of each SSP of the selected fraction of the plurality of SSPs.

29. A method of re-stimulating a subterranean formation, the method comprising:

extending the wellbore tubular of claim 1 within a casing conduit defined by a casing string of a hydrocarbon well that extends within the subterranean formation;

pressurizing the tubular conduit with a stimulant fluid that includes an abrasive material;

generating a shockwave within the tubular conduit and proximal a selected fraction of the plurality of SSPs with a shockwave generation device;

responsive to the generating, transitioning the isolation device of each SSP of the selected fraction of the plurality of SSPs from a respective closed state to a respective open state;

responsive to the transitioning, flowing the stimulant fluid through a selected SSP conduit of each SSP of the selected fraction of the plurality of SSPs such that the stimulant fluid impinges upon an inner casing surface of the casing string;

abrading the casing string, with the abrasive material of the stimulant fluid, to form a hole in the casing string, wherein a respective hole is associated with each selected SSP conduit;

responsive to formation of the hole, flowing the stimulant fluid into the subterranean formation to stimulate the subterranean formation, and wherein transitioning the isolation device from a closed state to an open state by at least one of:

(a) shattering a frangible disk that defines at least a portion of the selected isolation device of each SSP of the selected fraction of the plurality of SSPs; and (b) displacing an isolation disk, which defines at least a portion of the selected isolation device of each SSP of the selected fraction of the plurality of SSPs, from the selected SSP conduit of each SSP of the selected fraction of the plurality of SSPs.

* * * * *